US011598597B2

(12) United States Patent
Barrett et al.

(10) Patent No.: US 11,598,597 B2
(45) Date of Patent: Mar. 7, 2023

(54) SAFETY MECHANISM FOR FIREARMS

(71) Applicant: Sturm, Ruger & Comany, Inc., Southport, CT (US)

(72) Inventors: Jonathan Barrett, Georges Mills, NH (US); Nathan Brown, Kernersville, NC (US); Darin Nebeker, Gilbert, AZ (US); Todd Wilkinson, Goshen, NH (US)

(73) Assignee: STURM, RUGER & COMPANY, INC.

( * ) Notice: Subject to any disclaimer, the term of this patent is extended or adjusted under 35 U.S.C. 154(b) by 330 days.

(21) Appl. No.: 16/915,410

(22) Filed: Jun. 29, 2020

(65) Prior Publication Data

US 2021/0080211 A1 Mar. 18, 2021

Related U.S. Application Data

(60) Provisional application No. 62/867,423, filed on Jun. 27, 2019.

(51) Int. Cl.
*F41A 17/56* (2006.01)
*F41A 17/74* (2006.01)
(Continued)

(52) U.S. Cl.
CPC ..... *F41A 17/56* (2013.01); *F41A 17/30* (2013.01); *F41A 17/52* (2013.01); *F41A 17/74* (2013.01); *F41A 17/80* (2013.01)

(58) Field of Classification Search
CPC ..... F41A 17/30; F41A 17/32; F41A 17/52; F41A 17/56; F41A 17/62; F41A 17/70; F41A 17/74; F41A 17/80
See application file for complete search history.

(56) References Cited

U.S. PATENT DOCUMENTS 827,488 A * 7/1906 Whiting ..... F41A 17/38 89/138
929,491 A * 7/1909 Reifgraber ..... F41A 3/38 89/148

(Continued)

FOREIGN PATENT DOCUMENTS

BE 901429 A * 5/1985 ..... F41A 17/74
CN 105571387 4/2017

(Continued)

OTHER PUBLICATIONS

International Search Report and Written Opinion issued in International Application No. PCT/US20/40151 dated Sep. 15, 2020.

(Continued)

*Primary Examiner* — Gabriel J. Klein

(74) *Attorney, Agent, or Firm* — The Belles Group, P.C.

(57) ABSTRACT

A firearm with dual-acting safety mechanism includes a hammer, sear operable to hold the hammer in a cocked position, and trigger mechanism including a trigger and trigger bar which collectively operates to rotate the sear to release the hammer. The safety mechanism includes a safety mode selector or actuator cooperating with a secondary safety link. In one arrangement, linearly moving the selector actuates and rotates the safety link which simultaneously both blocks the hammer and displaces the trigger bar such that the sear can no longer be actuated via a trigger pull.

21 Claims, 36 Drawing Sheets

SAFE MODE
(trigger unpulled)

(51) Int. Cl.

| | |
|---|---|
| ***F41A 17/52*** | (2006.01) |
| ***F41A 17/80*** | (2006.01) |
| ***F41A 17/30*** | (2006.01) |

(56) References Cited

U.S. PATENT DOCUMENTS

| | | | | | |
|---|---|---|---|---|---|
| 1,511,509 | A | * | 10/1924 | Diehm | F41A 17/56 89/195 |
| 3,109,345 | A | * | 11/1963 | Norman | F41A 3/44 89/187.01 |
| 3,724,113 | A | | 4/1973 | Ludwig | |
| 3,949,508 | A | * | 4/1976 | Elkas | F41A 17/62 42/70.08 |
| 4,208,947 | A | | 6/1980 | Hillberg | |
| 4,282,795 | A | * | 8/1981 | Beretta | F41A 17/56 42/70.08 |
| 4,352,317 | A | * | 10/1982 | Wilhelm | F41A 17/74 89/154 |
| 4,589,327 | A | * | 5/1986 | Smith | F41A 17/74 89/196 |
| 4,590,697 | A | * | 5/1986 | Ruger | F41A 17/64 42/70.08 |
| 5,088,222 | A | * | 2/1992 | Larson | F41A 17/56 42/70.04 |
| 5,303,494 | A | * | 4/1994 | Tuma | F41A 17/74 42/70.04 |
| 5,400,537 | A | * | 3/1995 | Meller | F41A 17/82 89/147 |
| 5,697,178 | A | | 12/1997 | Haskell | |
| 5,915,935 | A | | 6/1999 | Weldle et al. | |
| 6,119,387 | A | | 9/2000 | Butters et al. | |
| 6,283,006 | B1 | | 9/2001 | Szabo et al. | |
| 6,539,658 | B1 | | 4/2003 | Hubert et al. | |
| 6,769,208 | B2 | | 8/2004 | Beretta | |
| 6,865,839 | B2 | | 3/2005 | Bantie et al. | |
| 7,213,358 | B2 | * | 5/2007 | Kellerman | F41A 19/48 89/147 |
| 7,243,453 | B2 | | 7/2007 | McGarry | |
| 7,263,796 | B2 | * | 9/2007 | Kellermann | F41A 19/47 89/147 |
| 7,360,331 | B2 | | 4/2008 | McGarry | |
| 8,033,043 | B2 | | 10/2011 | McGarry | |
| 8,127,481 | B2 | | 3/2012 | Rozum et al. | |
| 8,464,455 | B2 | | 6/2013 | Kallio | |
| 8,677,666 | B2 | | 3/2014 | Pichler | |
| 8,683,729 | B2 | | 4/2014 | Bova | |
| 8,966,803 | B2 | | 3/2015 | Dietel et al. | |
| 9,057,574 | B2 | | 6/2015 | McClave | |
| 9,303,936 | B2 | | 4/2016 | Toner | |
| 9,448,023 | B2 | | 9/2016 | Sheets, Jr. et al. | |
| 9,476,660 | B2 | | 10/2016 | Potter et al. | |
| 9,605,919 | B2 | | 3/2017 | Wengender | |
| 9,726,449 | B2 | | 8/2017 | Spinner et al. | |
| 10,175,019 | B1 | | 1/2019 | Al-Mutaw | |
| 2005/0229461 | A1 | | 10/2005 | McGarry | |
| 2012/0174454 | A1 | * | 7/2012 | Kallio | F41A 17/56 42/70.06 |
| 2012/0291326 | A1 | | 11/2012 | Bova | |
| 2013/0111795 | A1 | | 5/2013 | Dionne et al. | |
| 2015/0292828 | A1 | | 10/2015 | Nebeker et al. | |
| 2021/0247157 | A1 | * | 8/2021 | Lesenfants | F41A 17/56 |

FOREIGN PATENT DOCUMENTS

| | | | | | |
|---|---|---|---|---|---|
| DE | 582963 | C | * | 8/1933 | |
| DE | 102004007407 | A1 | * | 8/2004 | F41A 17/30 |

OTHER PUBLICATIONS

European Search Report 20831652.1, dated Jul. 14, 2022.

* cited by examiner

FIRE MODE
(trigger unpulled)

SAFE MODE
(trigger unpulled)

FIRE MODE
(trigger pulled)

SAFE MODE
(trigger pulled)

SAFETY MECHANISM FOR FIREARMS

CROSS-REFERENCE TO RELATED APPLICATIONS

The present application claims the benefit of priority to U.S. Provisional Application No. 62/867,423 filed Jun. 27, 2020; the entirety of which is incorporated herein by reference.

BACKGROUND

The present invention generally relates to firearms, and more particularly to user-actuated safety mechanisms for firearms.

Manual safeties for firearms are intended to reduce the chance of accidental discharge by disabling fire control components in the event a user fails to exercise proper firearm handling procedures. This can be achieved in numerous ways to block various components of the trigger-actuated firing mechanism. This may be particularly challenging for compact pistol platforms for concealed carry applications where available space within the firearm is limited.

Improvements in safeties are desired.

SUMMARY

According to aspects of the present disclosure, an auto-loading firearm with manually-actuated safety mechanism and a related method of operation are provided. The manual safety mechanism discloses herein provides a combination of a hammer blocker and a trigger linkage disconnect activated manually and simultaneously via a single safety mode selector or actuator accessible to the user. This advantageously forms a dual-acting safety mechanism to block discharge of the firearm in two different ways when the safety is activated for added security. In addition, the dual-acting safety mechanism has an efficient and compact configuration allowing it to be used in a compact conceal carry firearm in one possible implementation. In one non-limiting embodiment, the firearm may be a semi-automatic pistol.

A firearm according to the present disclosure therefore includes a manually operated safety mechanism configured to selectively arrest the firing control system. The safety mode selector or actuator is alterable between two axial positions and allows selection of a "SAFE" firing mode or position in which the firing mechanism is disabled, and a "FIRE" firing mode or position in which the firing mechanism is enabled to discharge the firearm.

In one embodiment, the safety selector or actuator may move in a linear manner forward/rearward. A secondary safety catch or link operably coupled to and cooperating with the actuator operates to disable the firing mechanism via movement in a rotary manner. The actuator and safety link in one embodiment are operably interfaced via a camming interface such that linearly changing the axial position of the selector or actuator by sliding the actuator in turn actuates and rotates the safety link via camming action to disable the firing mechanism. The actuator has an actuating member for grasping by the user which is exposed to change the safety mechanism between the SAFE and FIRE modes. Indicia which may be provided on the actuator provides visual confirmation of the status of the safety and firing mechanism. The safety link may be an internal component which is substantially located beneath and concealed by the firearm frame. In one embodiment, the actuator and safety link may be mounted to the frame and/or a firing control housing insert which supports the firing mechanism components (e.g. sear, hammer, etc.).

In one aspect and safety feature, the actuator comprises a cam operated trigger bar linkage disconnect feature which acts to physically move or displace the trigger bar, thereby misaligning an operating interface between the sear and trigger bar such that a trigger pull with the safety activated fails to actuate and rotate the sear which is necessary to release the hammer and fire the firearm. For example, when the safety mechanism (e.g. actuator) is in the FIRE position (e.g. actuator in a first axial position) and the trigger is pulled during normal operation, the trigger bar operating protrusion is axially aligned with the sear operating protrusion which falls in the same linear path of axial travel as the trigger bar operating protrusion. This allows the sear to be rotated via engagement with the trigger bar as it moves forward when the trigger is pulled. The sear when rotated far enough by the trigger bar via the trigger pull allows the hammer to sear-off (disengage the sear) and fully rotate to the forward firing position from its rear cocked position to strike the firing pin and discharge the firearm.

When the safety mechanism according to the present disclosure is actuated, however, the trigger bar is vertically displaced and axially misaligned with the sear operating protrusion when the safety mechanism is in the SAFE position (e.g. actuator in second axial position). In other words, the trigger bar and sear operating protrusions no longer lie in the same linear path of axial travel necessary to rotate the sear via a trigger pull. As such, the trigger can be pulled and moved but without causing the trigger bar to engage and operate the sear. This axial misalignment is induced by the rotation of the secondary safety link caused by the manual linear movement of the actuator between its two possible axial operating positions, which in turn pushes the trigger bar downwards below the sear operating protrusion on the sear in one embodiment. The secondary safety link has a cam surface configured to interact with the cam of the safety actuator to transfer linear fore-aft motion of the actuator into rotational motion of the safety link, as further described herein. The trigger bar of the present firearm is therefore moveable via the dual-acting safety mechanism between an upper position axially with the which is engageable with sear, and a lower position which is misaligned and not engageable with the sear.

In another aspect and safety feature, the secondary safety link advantageously also comprises a hammer blocker feature which works by preventing sear-off between the hammer and sear of the firing control mechanism for preventing the hammer from rotating and striking the firing pin to discharge the firearm when the trigger is pulled. With the provided safety link is rotated downwards by the actuator when in the SAFE position, the safety link positively engages and blocks the hammer from rotating and striking the firing pin in the unlikely situation that the hammer is unintentionally caused to sear-off during a high impact situation (e.g. such as the firearm being dropped onto a hard surface). This provides an added security feature to disable the firing control mechanism in addition to displacement of the trigger bar described above.

According to one aspect, a firearm with safety mechanism comprises: a longitudinal axis; a frame; a hammer pivotably disposed in the frame, the hammer moveable between a rearward cocked position and a forward firing position; a sear pivotably disposed in the frame and configured to hold the hammer in the rearward cocked position; a trigger mechanism comprising a trigger and trigger bar movable therewith, the trigger bar movable to selectively engage the sear for releasing the hammer from the cocked position via a trigger pull to discharge the firearm; a manually-operated safety mechanism comprising a movable actuator and a pivotably movable safety link operably interfaced with the actuator, the safety link actuatable via moving the actuator between first and second positions; the safety link comprising a first protrusion arranged to selectively engage the hammer when the safety link is actuated, and a second protrusion arranged to selectively engage the trigger bar when the safety link is actuated; wherein via moving the actuator, the safety mechanism is changeable between a fire position in which the safety link is disengaged from the hammer and trigger bar which allows the firearm to be discharged in response to a trigger pull, and a safe position in which the safety link is engaged with the hammer and trigger bar to prevent the firearm from being discharged in response to a trigger pull.

According to another aspect, a firearm with dual-acting safety mechanism comprises: a longitudinal axis; a frame; a hammer pivotably movable in the frame, the hammer moveable between a rearward cocked position and a forward firing position; a sear pivotably movable in the frame and configured to hold the hammer in the rearward cocked position; a trigger mechanism comprising a pivotably movable trigger and a trigger bar movably coupled to the trigger, the trigger bar axially moveable via pulling the trigger to selectively engage and rotate the sear for releasing the hammer from the cocked position to discharge the firearm; a manually-operated safety mechanism comprising an axially slideable safety mode selector and a pivotably movable safety link, the safety link moveable between unactuated and actuated positions via sliding the actuator between first and second axial positions; the safety link comprising a first nose protrusion on one lateral side of the firearm which is selectively operable when the safety link is in the actuated position to engage and block rotation of the hammer to prevent discharging the firearm; the safety link further comprising a second foot protrusion on an opposite lateral side of the firearm which is selectively operable when the safety link is in the actuated position to engage and displace the trigger bar such that the trigger bar is prevented from engaging and rotating the sear to prevent discharging the firearm.

According to another aspect, a dual-acting safety mechanism for a firearm having a firing mechanism with a rotatable hammer, a rotatable sear, and a trigger assembly including a trigger and trigger bar movably coupled thereto for fore and aft movement, the safety mechanism comprises: a longitudinal axis; a frame; a safety selector linearly movable in the frame between a forward position and a rearward position; a safety link pivotably movable in the frame and operably interfaced with the actuator, the safety link pivotably actuatable via moving the actuator between an upper position and a lower position; the safety link comprising a first lateral side including a first safety protrusion configured to selectively block rotational movement of the hammer when the safety link is actuated, and a second safety protrusion configured to selectively engage the trigger bar when the safety link is actuated; wherein the safety mechanism is changeable between a fire position in which the safety link is disengaged from the hammer and trigger bar which allows the firearm to be discharged in response to a trigger pull, and a safe position in which the safety link is engaged with the hammer and trigger bar to prevent the firearm from being discharged in response to a trigger pull.

According to another aspect, a firearm with dual-acting safety mechanism comprises: a pivotable hammer; a rotatable sear operable to selectively hold the hammer in a cocked position; a trigger mechanism including a movable trigger and trigger bar which collectively operates to rotate the sear to release the hammer when in the cocked position; and a safety mechanism including a safety mode selector cooperating with a pivotably movable secondary safety link configured and operable to engage the trigger bar and hammer; wherein linearly moving the selector actuates and rotates the safety link which simultaneously both blocks the hammer and displaces the trigger bar such that the sear can no longer be actuated via a trigger pull According to yet another aspect, a method for disabling the firing mechanism of a firearm comprises: providing a firearm comprising a firing mechanism including a hammer pivotable between rearward cocked and forward firing positions, a rotatable sear configured to hold the hammer in the cocked position, a movable trigger and trigger bar assembly operable to engage and rotate the sear to release the hammer from the cocked position, and a safety mechanism comprising an actuator and safety link operably interfaced with the firing mechanism; rotating the hammer to the cocked position; engaging the hammer with the sear which holds the hammer in the cocked position; sliding the actuator of the safety mechanism in a first direction; rotating the safety link via camming action between the actuator and the safety link; and engaging the safety link with both the hammer and trigger bar to disable the firing mechanism. The method may further include the engaging step comprising engaging a first protrusion of the safety link with the hammer to block rotation thereof from the cocked position, and engaging a second protrusion of the safety link with the trigger bar which displaces the trigger bar such that rotating the sear via a trigger pull disables release of the hammer from cocked position by the sear.

BRIEF DESCRIPTION OF THE DRAWINGS

The features of the exemplary embodiments will be described with reference to the following drawings where like elements are labeled similarly, and in which.

Figure 1:
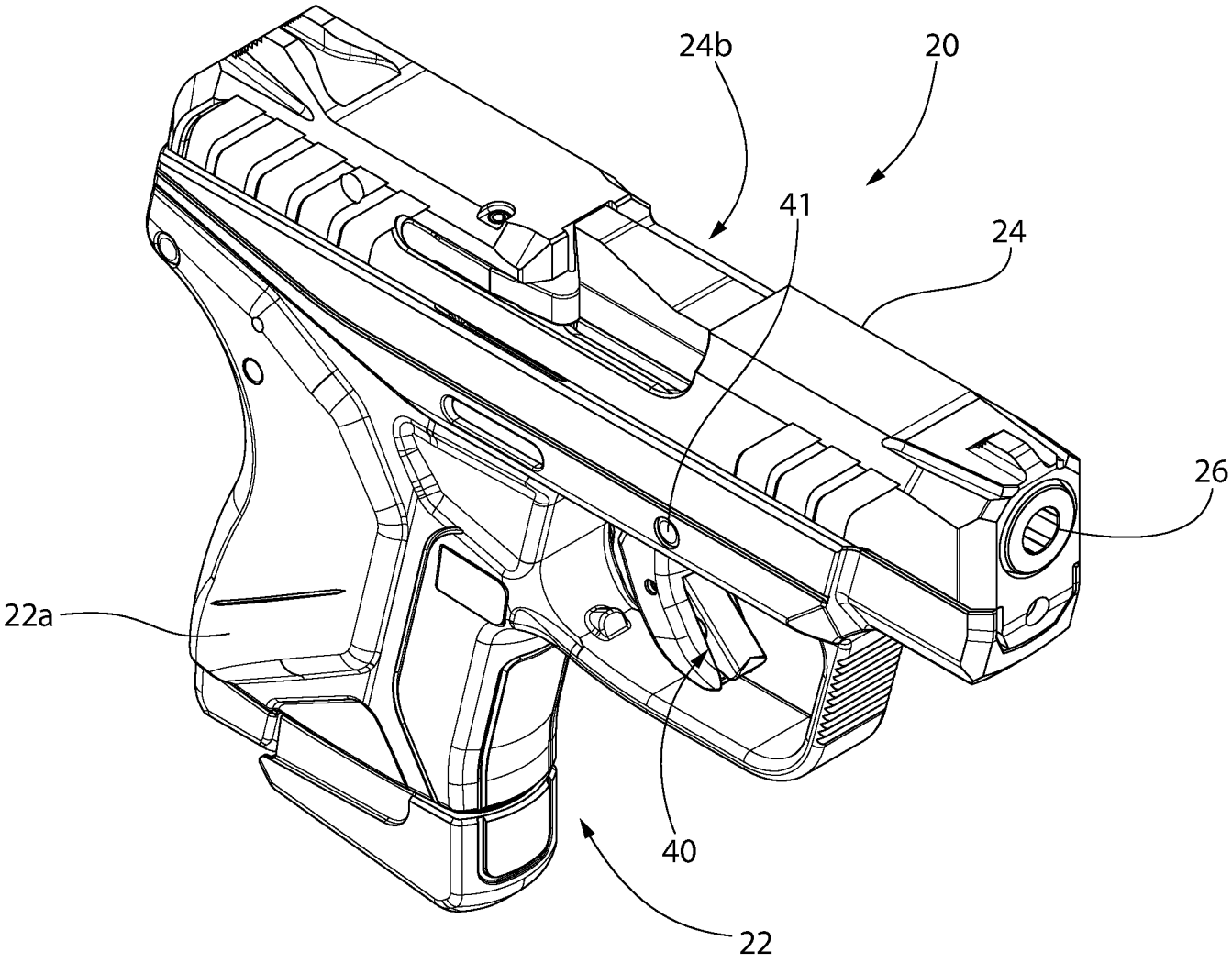
FIG. 1 is a right side perspective view of one exemplary embodiment of a firearm in the form of a pistol with a dual-acting safety mechanism according to the present disclosure.
Figure 2:
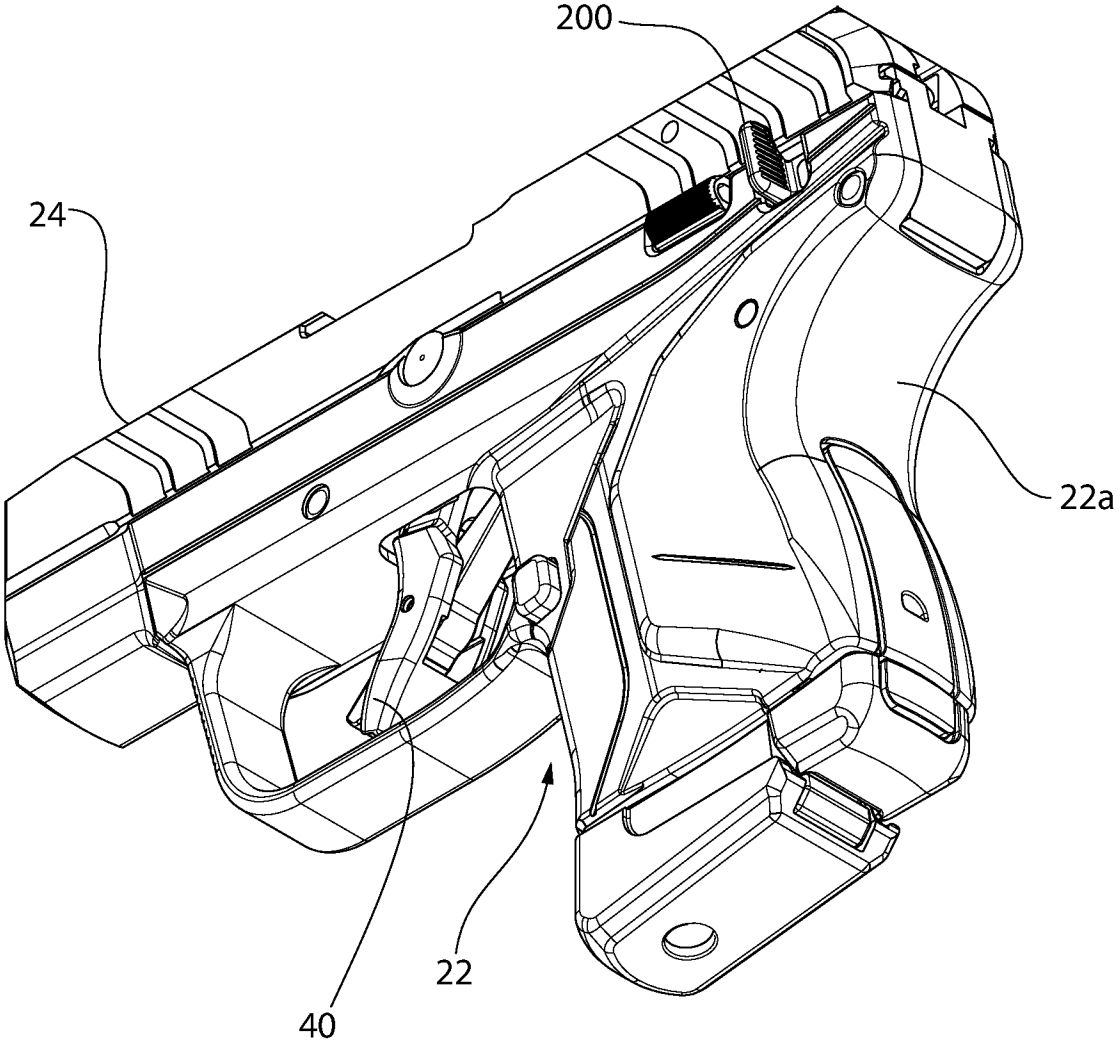
FIG. 2 is a left side perspective view thereof.
Figure 3:
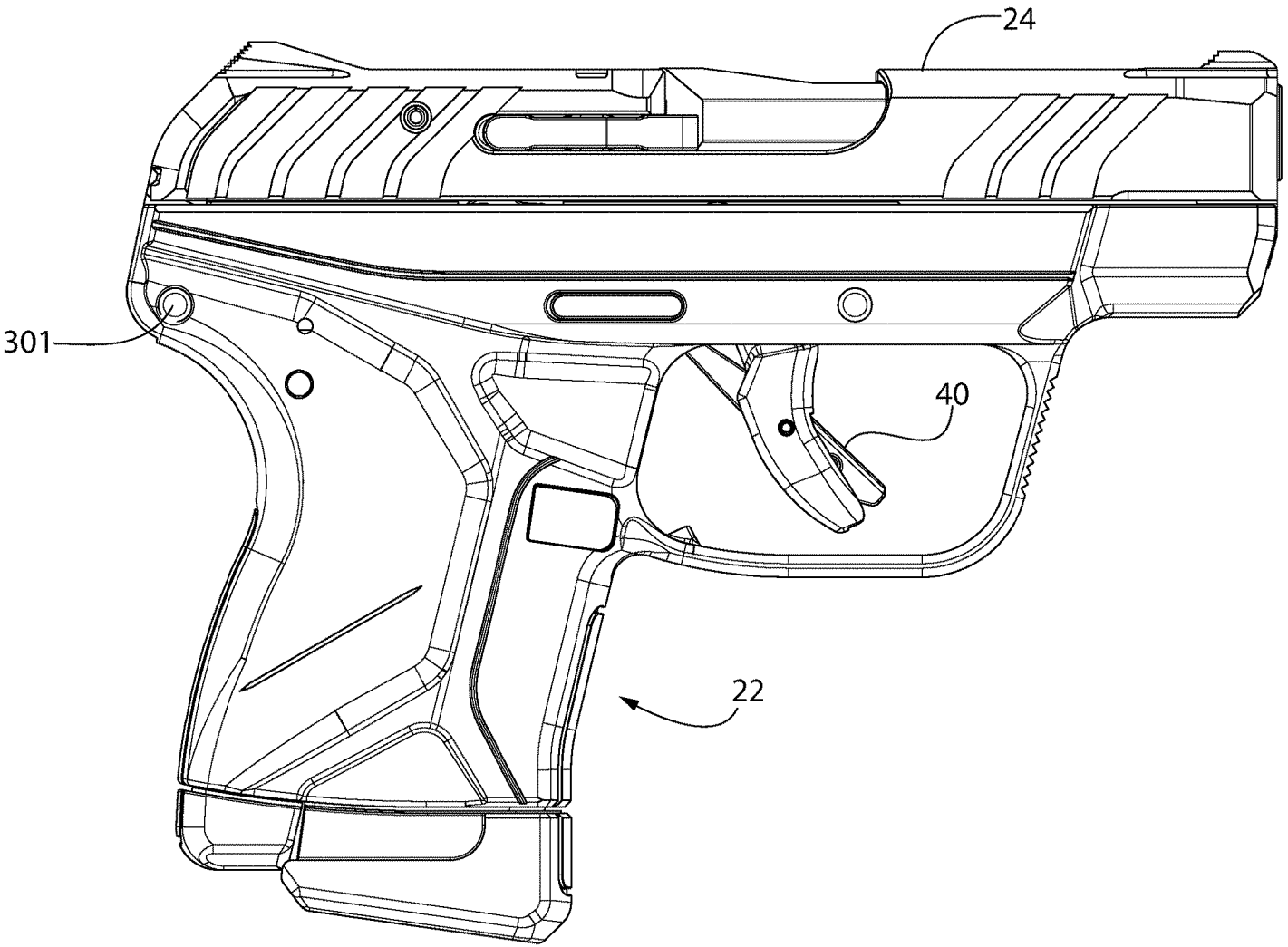
FIG. 3 is a right side elevation view thereof.

All drawings shown herein are schematic and not necessarily to scale. A reference herein to a figure by number which may include several sub-part figures having the same number but different alphabetical suffixes (e.g. 24A, 24B, etc.) shall be construed as a reference to all sub-part figures unless explicitly noted otherwise.

DETAILED DESCRIPTION

The features and benefits of the invention are illustrated and described herein by reference to exemplary ("example") embodiments. This description of exemplary embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise. Moreover, the features and benefits of the invention are illustrated by reference to the exemplary embodiments. Accordingly, the invention expressly should not be limited to such exemplary embodiments illustrating some possible non-limiting combination of features that may exist alone or in other combinations of features; the scope of the invention being defined by the claims appended hereto.

An exemplary auto-loading firearm incorporating an embodiment of the dual functioning safety mechanism according to principles of the present invention will now be described with reference to a semi-automatic firearm in the form of a pistol 20. The principles and features of the embodiments disclosed herein, however, may be embodied with equal benefit in other types of auto-loading firearms using any caliber ammunition and including long guns such as rifles or shotguns. Accordingly, the invention is not limited in its applicability or scope to pistols alone as described herein.

FIGS. 1-12 generally depict various overall and cross-sectional views of pistol 20, which may be a compact concealed carry firearm in one non-limiting embodiment such as without limitation a Ruger® LCP II. FIGS. 13-27H generally depict various views of portions and details of the firearm assembly and mechanisms without the outer frame showing internal mechanisms of the firearm and various components thereof including those of the firing control system and present dual functioning safety mechanism.

Referring initially now to FIGS. 1-12, pistol 20 includes a frame 22 having a rear downwardly extending grip portion 22*a* for grasping and a longitudinally-extending cavity 22*b* which opens upwards and receives firing control housing insert 80 removable mounted therein. Firing control housing insert 80 supports various firing control mechanism components which advantageously may be mounted therein prior to inserting the insert into the frame 22 to facilitate assembly of the pistol. Accordingly, the firing control housing insert 80 with firing control mechanism components is mountable in frame 22 as a unit. Advantageously, this allows the firing control components to be pre-mounted in the insert 80 in a simplified and readily more accessible manner rather than mounting the components individually in the frame. In other embodiments, the firing control mechanism components may be directly mounted in frame 22 without use of an insert 80. The invention is therefore expressly not limited to either arrangement.

Slide 24 is slideably mounted on pistol 20, and in one embodiment on firing control housing 80 and/or frame 22 via a support rail and groove system for axial reciprocating movement forwards and rearwards thereon. Such systems are known and understood by those in the art without further elaboration. A recoil spring 29 operably associated with slide 24 and mounted on a guide rod 29*a* acts to return the slide to the forward position shown in FIGS. 9 and 10 after discharging pistol 20. A magazine 50 may be removably inserted into frame 22 and firing control housing 80. The frame 22 may define a magazine well 21 with open bottom configured for receiving and supporting magazine 50 therein. Magazine 50 is sized and configured for holding a stack of and dispensing a plurality of cartridges C. Slide 24 includes an ejection port 24*b* for ejecting spent cartridge casings from the firearm when the action is cycled in the usual manner.

Pistol 20 further includes a barrel 26 that is movably disposed at least partially inside slide 24 and includes a rear chamber block 28 defining an open chamber 30 therein configured for receiving a cartridge. Breech area 23 is defined at the rear of barrel 26 and chamber 30 in the slide 24 for loading cartridges C therein from magazine 50. Slide 24 includes a breech block defining a frontal breech face 24*a* which is axially moveable with the slide in relation to the chamber 30 to alternatingly form an open or closed breech in a manner well known in the art. The breech is shown closed in FIGS. 9 and 10 with front breech face on slide abutted against rear breech end of the barrel/chamber. Pistol 20 further includes a longitudinal axis LA defining an axial direction and which is approximately concentrically aligned with bore 26*a* of barrel 26 and slide 24 as shown in FIG. 1. The bore may be rifled as shown. Barrel 26 is moveable rearwards with slide 24 on firing control housing 80 under recoil after discharging pistol 20 in one embodiment. In other embodiments, the barrel 26 may remain stationary after discharging the pistol. Slide is movable rearwards on frame 22 under recoil or when manually cycling the action.

A spring-biased elongated slide stop 65 is configured to engage the slide and retain it in a rearward open breech position. The slide stop includes an upright protrusion 65*a* configured to engage a corresponding stop notch 65*b* formed on the slide (see, e.g. FIGS. 7 and 12) when in a rearward open breech position. When the last shot has been fired and the magazine is empty, the slide stop automatically locks the slide open. The slide stop may be pivotably mounted on the trigger pivot pin 41 and the left side of the pistol.

Figure 7A:
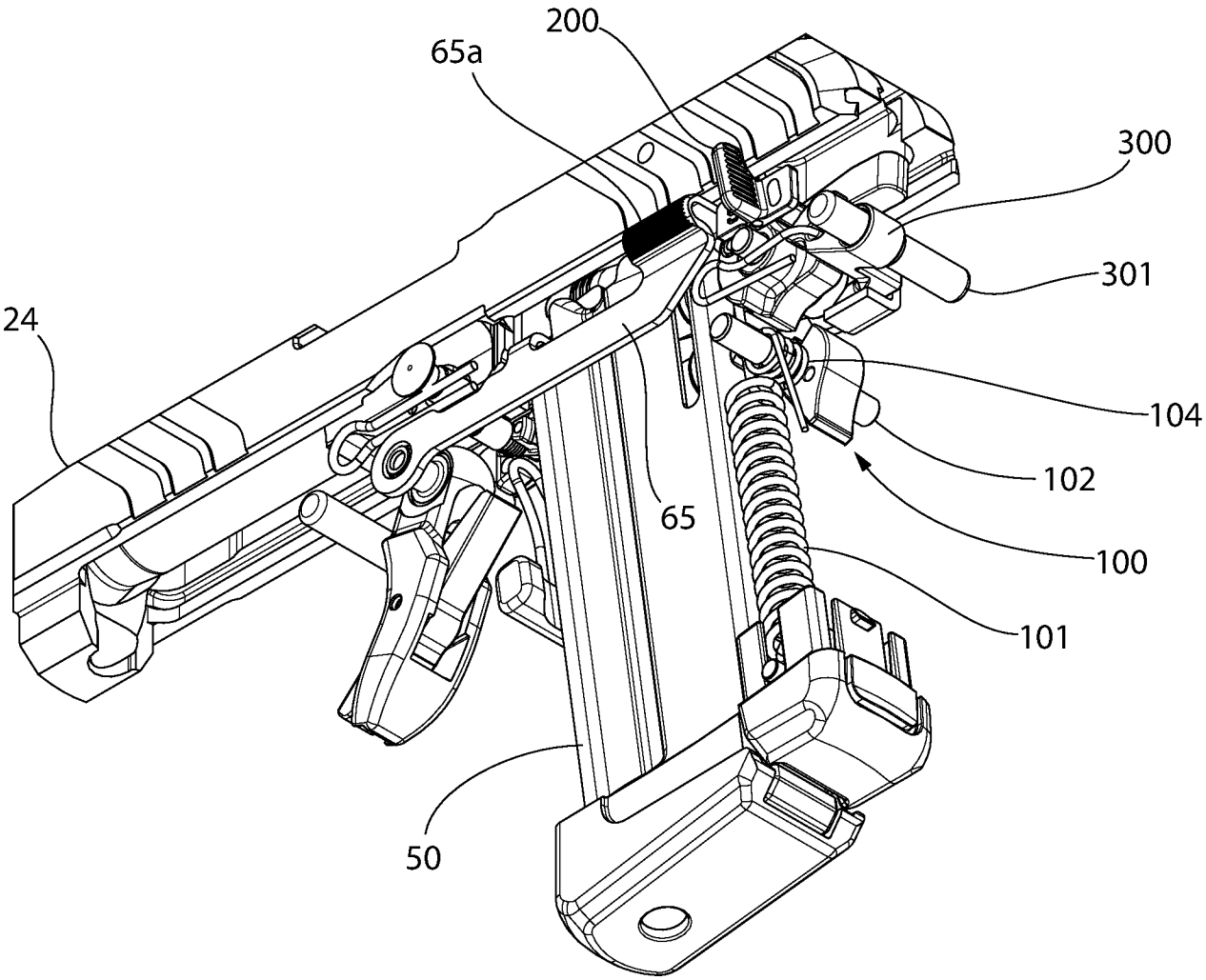
FIG. 7A is a left side perspective view thereof without the frame of the firearm.
Figure 7B:
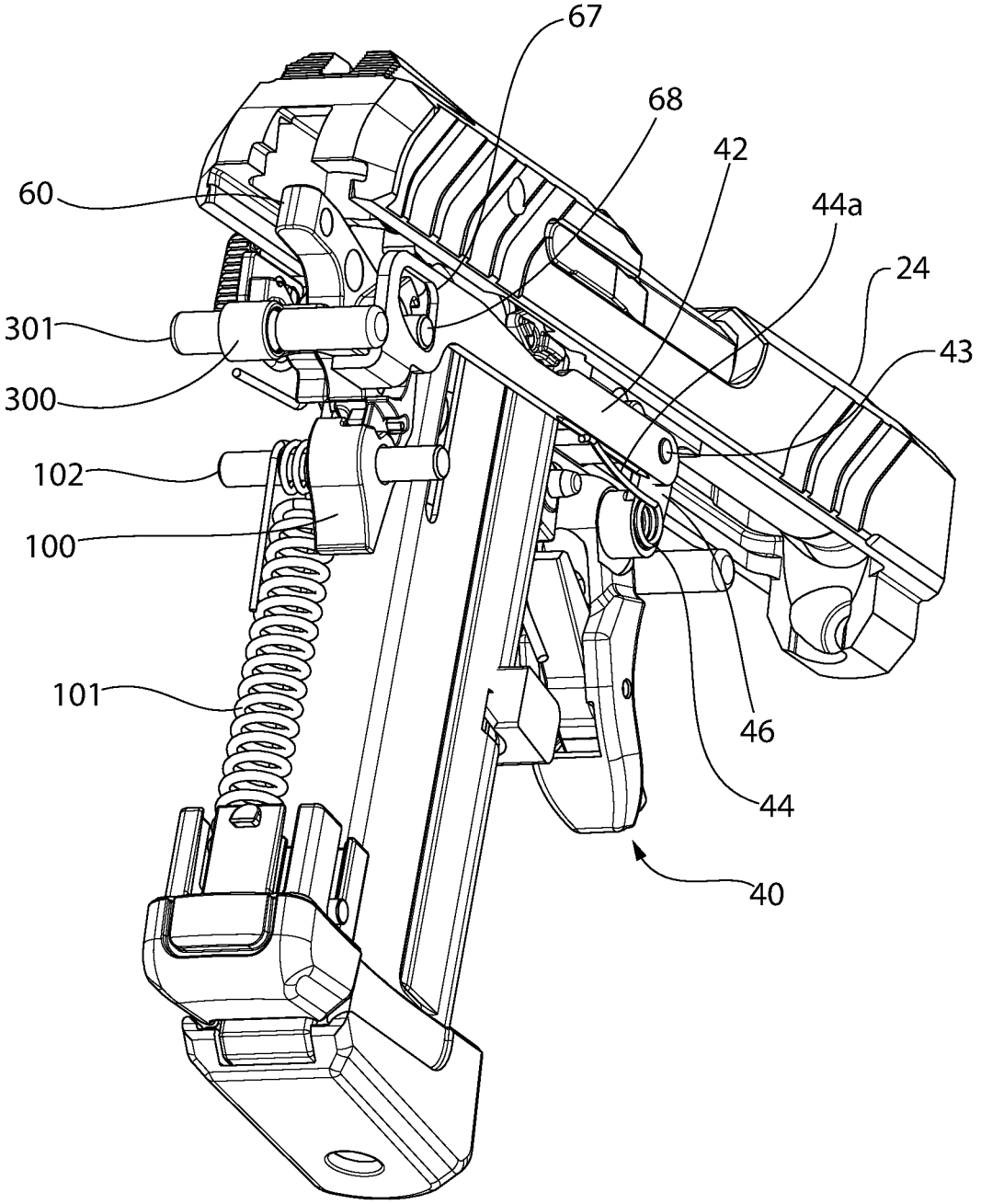
FIG. 7B is a right side perspective view thereof without the frame.
Figure 8:
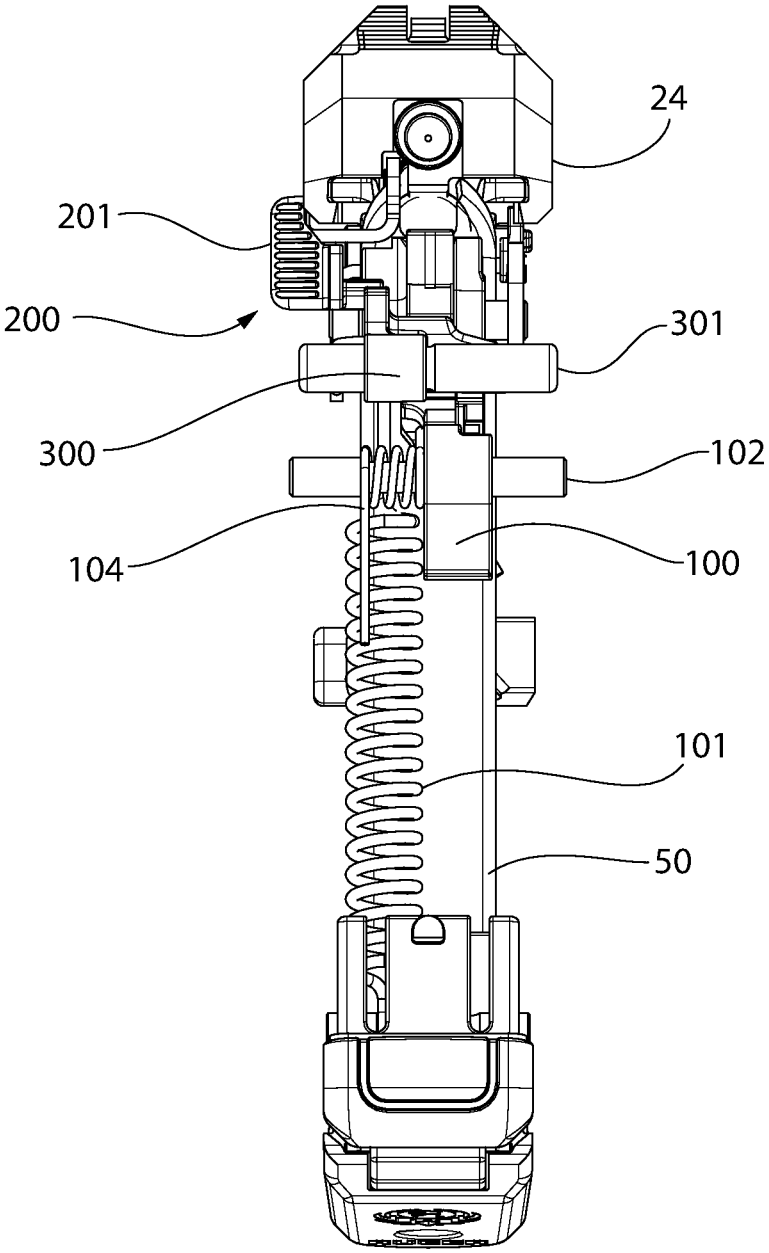
FIG. 8 is a rear view thereof without the frame.
Figure 9:
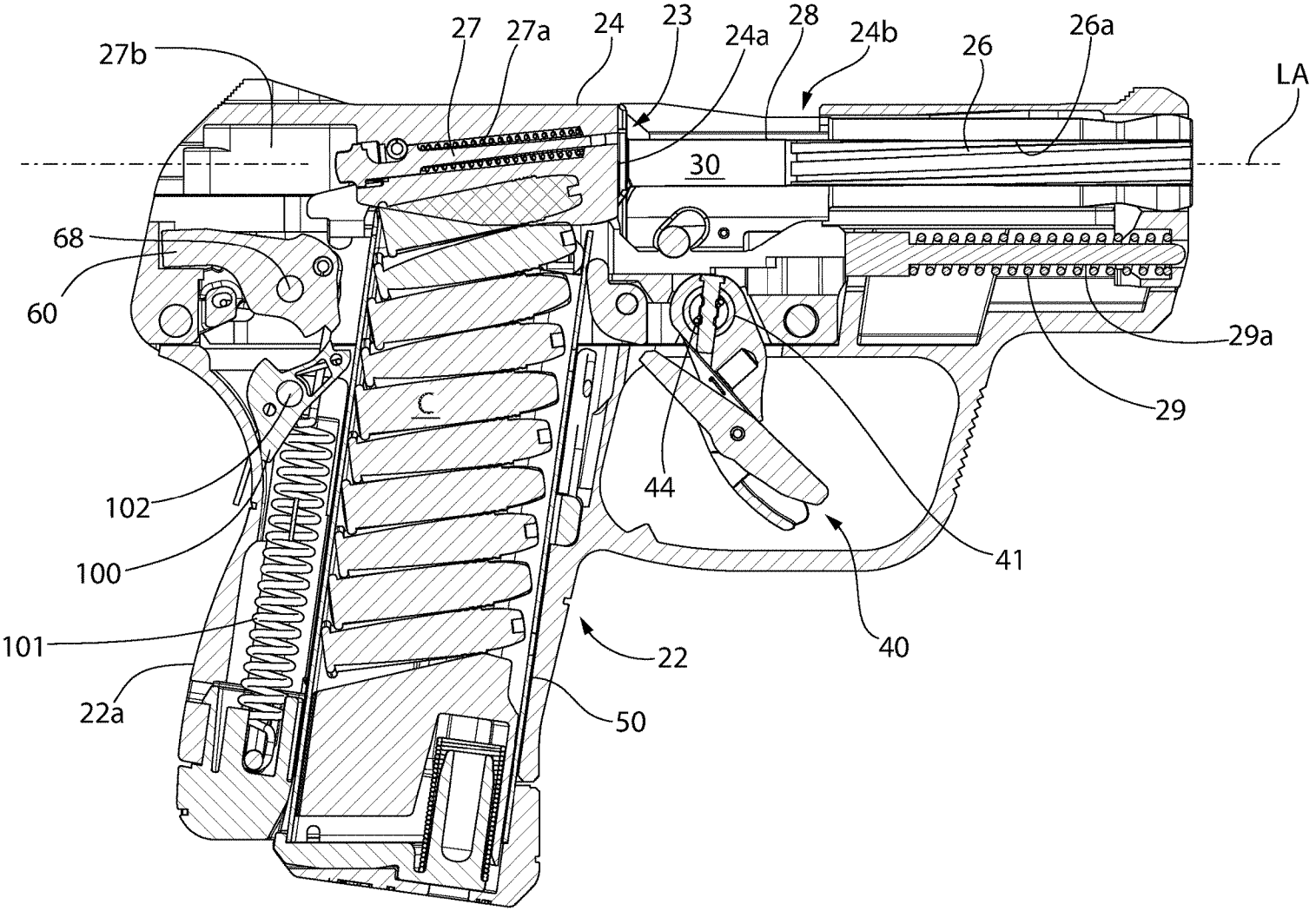
FIG. 9 is a right side cross-sectional view thereof.
Figure 10:
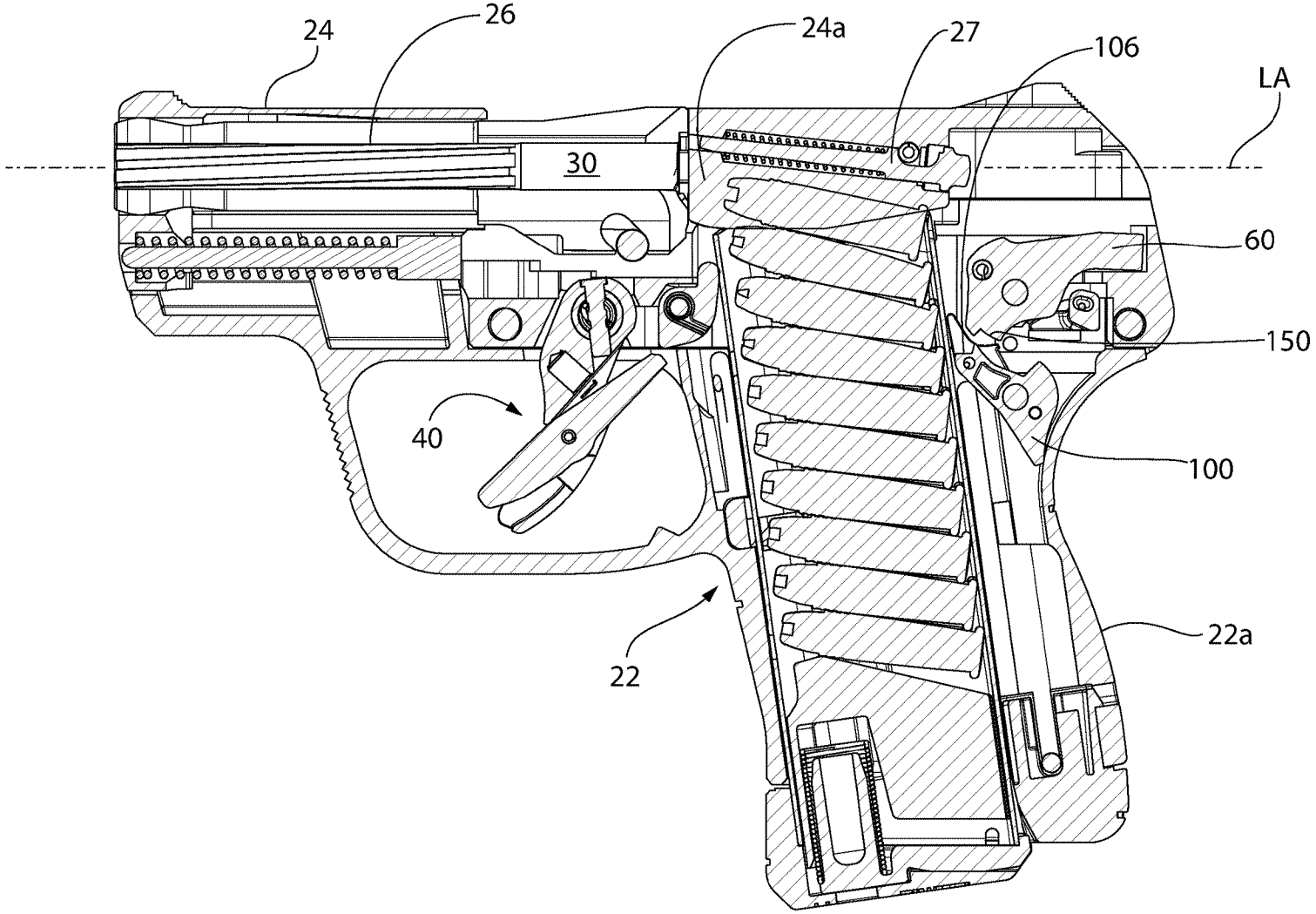
FIG. 10 is a left side cross-sectional view thereof.

Referring generally to FIGS. 1-19, the firing control mechanism in one embodiment includes a trigger assembly including a trigger 40 pivotally mounted in frame 22 to firing control housing 80 via transverse pin 41 and an axially (longitudinally) movable trigger bar 42 pivotally coupled to the trigger via transverse pivot pin 43 on an upright trigger pivot extension 46 (see, e.g. FIG. 7B). Extension 46 may be disposed on or integrally formed with the trigger pivot pin 41 in some embodiments. Pulling trigger 40 rearward moves trigger bar 42 axially forward. The trigger 40 may be a dual trigger assembly in one embodiment including an outer trigger member and an inner safety trigger member pivotably movable relative thereto. Firing the firearm via a trigger pull in normal fashion requires each trigger to be intentionally pulled fully rearward. Operation of such safety trigger systems is well known in the art without further elaboration.

An axially movable spring-biased firing pin 27 is supported by slide 24 and positioned for rearward retraction and forward release to strike a chambered cartridge C to discharge the pistol 20. The firing pin 27 is actuated and released via the trigger assembly through a trigger pull. Accordingly, the combination of the trigger assembly and firing pin 27 together define a means for striking a chambered cartridge to discharge pistol 20. Firing pin spring 27*a* positioned concentrically around the axially firing pin body. Spring 64 may be a helical compression coil spring in one embodiment, or other suitable type spring operable to bias the firing pin towards the chamber 30. The firing pin may have a diametrically narrowed front end configured to contact the rear of cartridge C for detonating the cartridge whereas the rear end may be diametrically enlarged relative thereto. The rear end may be exposed in a rear cavity 27*b* of the slide where it can be reached and struck by the spring-biased rotating hammer 60 when released from the sear. This drives the firing pin forward to strike and detonate the cartridge in the usual manner known in the art.

A trigger return spring 44 may further be provided which in one embodiment may be a torsion spring that is mounted about trigger pin 41 and biases trigger 40 toward the fully forward ready-to-fire position shown in FIGS. 1 and 5A. Trigger spring 44 may further include a rearwardly extending leg 44*a* (see, e.g. FIG. 15) configured to act on the underside of trigger bar 42 to bias the trigger bar upwards towards engagement with hammer 60. In other embodiments, separate springs may be used to bias the trigger bar upwards.

The firing control system or mechanism further includes the hammer 60 for striking the firing pin 27 and a sear 100 cooperating with the hammer which operate in conjunction to fire the pistol via a trigger pull. The sear acts in a convention manner to retain the hammer 60 in a rearward pivoted cocked position until the trigger is pulled. Sear 100 is pivotably mounted to firing control housing insert 80 via a transverse sear pin 102 which defines a transverse pivot axis. Sear 100 is biased in an upwards or upright direction and orientation towards engagement with the hammer (counter-clockwise as viewed in FIGS. 17-18) by sear spring 104. In one embodiment, sear spring 104 may be a torsion spring having the coiled portion wound around sear pin 102 (see also FIG. 7). A downward extending leg 104*a* of spring 104 is braced against a portion of the frame 22 for leverage.

Sear 100 is shown in further isolated detail in FIGS. 25A-D. Hammer 60 is shown in further isolated detail in FIGS. 24A-D. Sear 100 has a body including an elongated extension arm 100*a* projecting upward above the sear pin 102. Extension arm 100A defines both a hammer catch protrusion 106 engageable with the hammer and an operating protrusion 108 engageable with the trigger bar 42. Hammer catch protrusion 106 defines a laterally broadened and elongated catch surface 106*a* which is selectively engageable with a complementary dimensioned hammer notch 150 formed on hammer 60 (see, e.g. FIGS. 24A-C) for retaining the hammer in the rearward cocked position. Hammer notch 150 has a mating rear facing notch surface 150*a* which engages the front facing sear catch surface 106*a* via a substantially flat-to-flat interface. An associated guide protrusion 107 projects upwards alongside the catch protrusion 106 and is nested against a lateral side of hammer 60 when the catch surface engages the hammer notch 150. This is intended to provide positive engagement between the sear and hammer to retain the hammer in the cocked position prior to an intentional trigger pull. It bears noting that the hammer notch 150 and catch protrusion 106 on sear 100 are not shown engaged as necessary to retain the hammer 60 in the cocked position in FIGS. 9 and 10 for clarity of depiction. A downwardly extending lobed stop portion 109 acts as a rotational travel stop which engages the frame and limits the disengagement distance between the sear and hammer (see, e.g. FIG. 9). A transverse through opening 105 which receives sear pivot pin 102 is located approximately midway between the stop portion 109 and extension arm 100*a* in the central portion of the sear body as shown.

Hammer 60 includes an upper striking portion 61 defining a substantially flat front facing striking surface 61*a* for striking the rear end of firing pin 27 to discharge the pistol. A lower operating portion 62 is defined by the hammer body which defines the hammer notch 150 and notch surface 150*a* previously described herein. A transverse through opening 66 which receives hammer pivot pin 68 is located approximately midway between the striking and operating portions in the central portion of the hammer body as shown. Hammer pivot pin 68 extends laterally and transversely to longitudinal axis LA through the firing control housing insert 80 and defines a corresponding transverse pivot axis of the hammer. The hammer and sear pivot pins 68, 102 are oriented parallel to each other and perpendicularly transverse to the longitudinal axis. Hammer spring 101 biases the striking portion 61 of hammer 60 forward toward the firing pin 27. Spring 101 may be an elongated coil spring housed in the rear grip portion 22*a* of frame 22 (see, e.g. FIG. 9).

Figure 17:
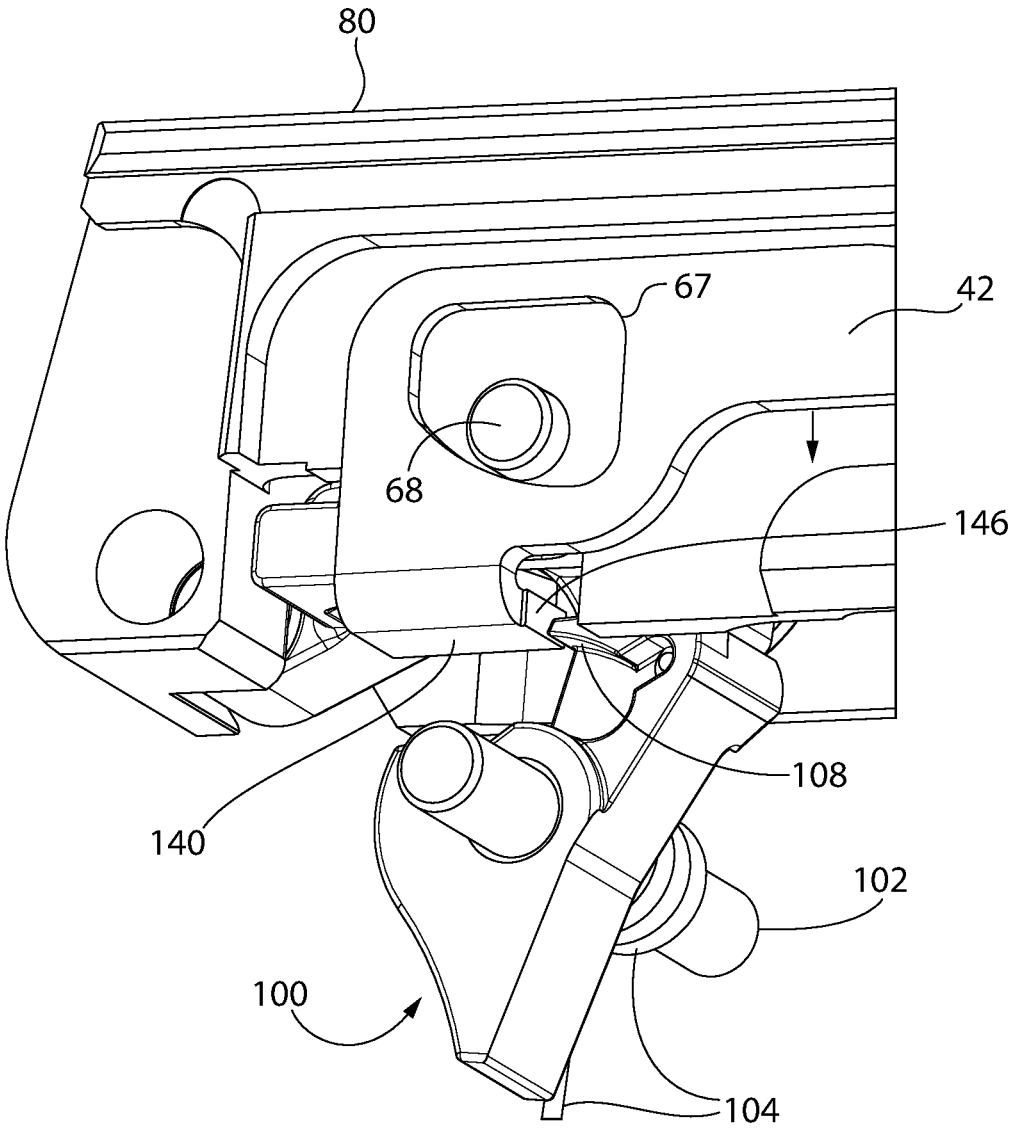
FIG. 17 is an enlarged detail showing the trigger bar operating protrusion axially aligned with the sear operating protrusion for actuating the sear via a trigger pull.
Figure 18:
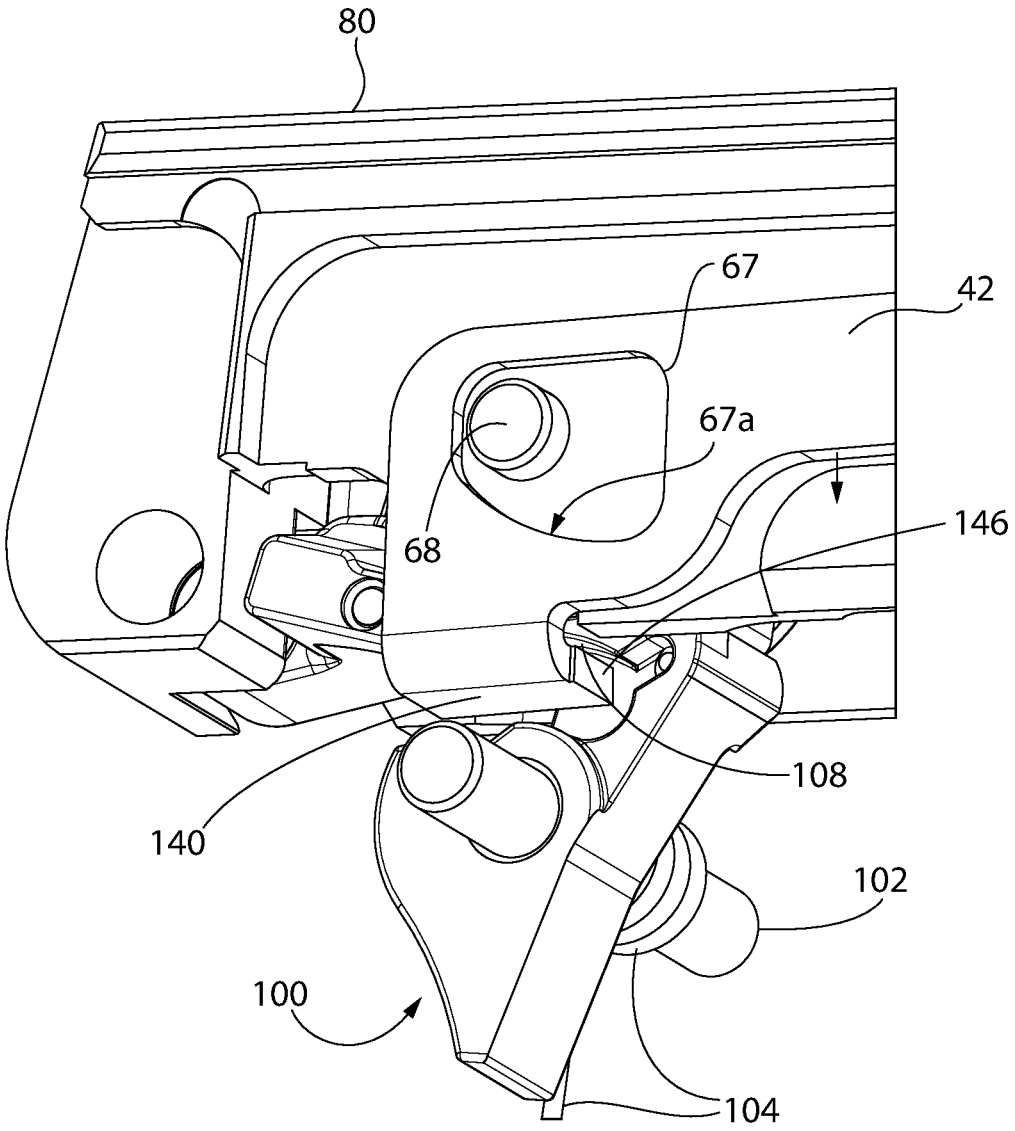
FIG. 18 is an enlarged detail showing the trigger bar operating protrusion axially misaligned with the sear operating protrusion via operation of the safety mechanism which will fail to actuate the sear via a trigger pull.

Operating protrusion 108 of sear 100 extends in a rearward direction from extension arm 100*a* and is selectively engageable with a corresponding forward facing operating surface 146 formed on the trigger bar 42 for rotating the sear via a trigger pull to discharge the pistol. Operating surface 146 may be defined by an inwardly and laterally-extending portion such as trigger bar operating protrusion 140 as best shown in FIGS. 17-18. In one embodiment, trigger bar operating protrusion 69 may be configured as a generally flat flange projecting laterally inwards from the axially elongated flattened body of the trigger bar 42 when mounted in the pistol and firing control housing 80.

With general reference to FIGS. 14-20, trigger bar 42 may have a generally flat and relatively thin plate-like structure having an axially elongated configuration (i.e. along the direction of longitudinal axis LA). The trigger bar 42 may be located on the right lateral side of the firearm between the frame 22 and firing control housing insert 80. In one embodiment, the rear end portion of trigger bar 42 may be enlarged in height having a generally bulbous shape that further defines an axially elongated operating window 67 configured to receive and engage the right end portion of hammer pivot pin 68 best shown in FIGS. 17-18. Pivot pin 68 acts as a vertical travel stop to limit the upward-most position of trigger bar 42 under the biasing force of trigger spring 44 via which lifts the trigger bar via engagement between the bottom surface 67*a* in the window 67 and pivot pin 68 (see, e.g. FIG. 17). In one embodiment, the bottom surface 67*a* which slideably engages the hammer pivot pin 68 may be arcuately curved for smooth engagement with the round profile of the pivot pin. The hammer pivot pin 68 also limits the downward displacement of the trigger bar 42 when the safety mechanism is activated, as further described herein. The inwardly and laterally extending flange-like operating protrusion 140 of the trigger bar may be located in the rear end portion of the trigger bar 42 proximate to and at least partially below the window 67 as shown.

Operation of the firing control mechanism will now be briefly described with initial reference to in FIGS. 9-10 and 14-16. Starting with pistol 20 in the ready-to-fire position (with closed breech), hammer 60 is shown cocked rearwards and held in the cocked position by sear 100. Specifically, hammer catch protrusion 106 is engaged with hammer notch 150 formed on hammer 60 which prevents the hammer from rotating forward under the biasing action of hammer spring 101. Lateral trigger bar operating protrusion 69 of trigger bar 42 and forward facing operating surface 146 thereon is longitudinally axially aligned with rearwardly projecting operating protrusion 108 on sear 100 and readied for firing (see, e.g. FIG. 17). Pulling trigger 40 rearward causes trigger bar 42 pivotally coupled to the trigger via transverse pivot pin 43 on an upright trigger pivot extension 46 to translate linearly forward. As trigger bar 42 moves forward, trigger bar operating protrusion 69 engages operating protrusion 108 on sear 100 which rotates the sear forward (clockwise in FIG. 17). The sear falls and breaks contact with the hammer 60 which releases the hammer. Without engagement by the sear, hammer 60 rotates forward under the biasing force of hammer spring 101 and strikes the rear of firing pin 27, driving the firing pin forward to strike a chambered cartridge and discharge pistol 20. The slide 24 cycles rearward in recoil to open the breech so that the spent cartridge casing can be extracted and ejected from the chamber. This action also resets the hammer to the cocked position and allows the sear to reengage the hammer and retain the cocked position. After discharging pistol 20 when the trigger is released, the firing control mechanism returns to the foregoing ready-to-fire position shown in FIGS. 1-4 in a conventional manner under the biasing force of recoil spring 29 which returns the slide forward to reclose the breech for the next shot. Trigger 40 and trigger bar 42 return to their pre-discharge ready-to-fire positions.

The safety mechanism according to the present disclosure and operation will now be described. Referring generally to FIGS. 1-23, the safety mechanism may include the primary safety mode selector or actuator 200 which moves in a linear manner forward/rearward along longitudinal axis LA in the frame 22 and operably interacts with a secondary safety link 300 which moves in a pivotable manner about a pivot axis. Safety link 300 is configured to in turn act on both the trigger bar and hammer simultaneously to block normal operation of the firing mechanism for firing the pistol, as further described herein. FIGS. 26A-H and 27A-H show actuator 200 and safety link 300 respectively in isolation and greater detail.

Figure 4:
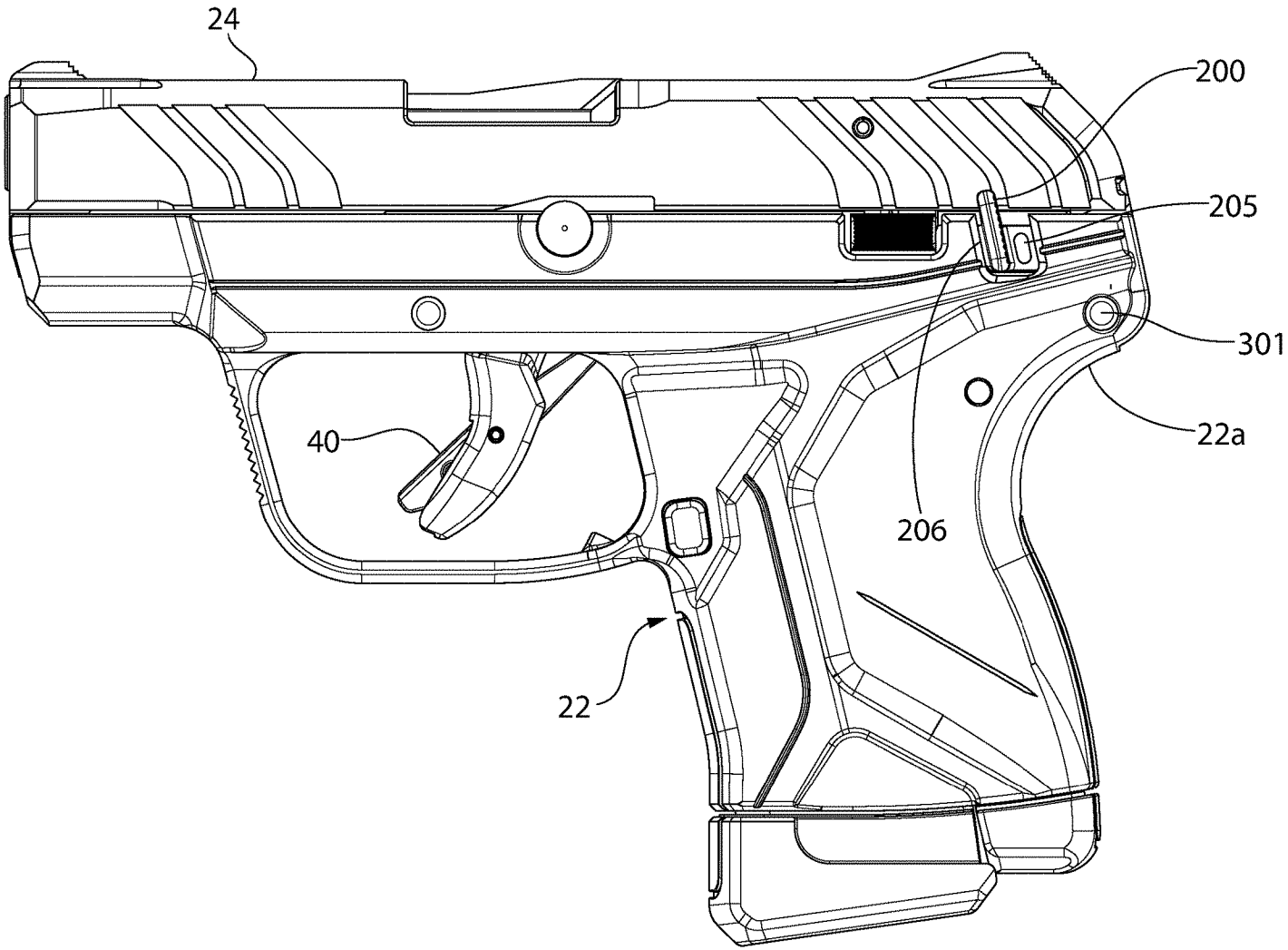
FIG. 4 is a left side elevation view thereof, the safety selector shown in the FIRE mode/position.
Figure 11:
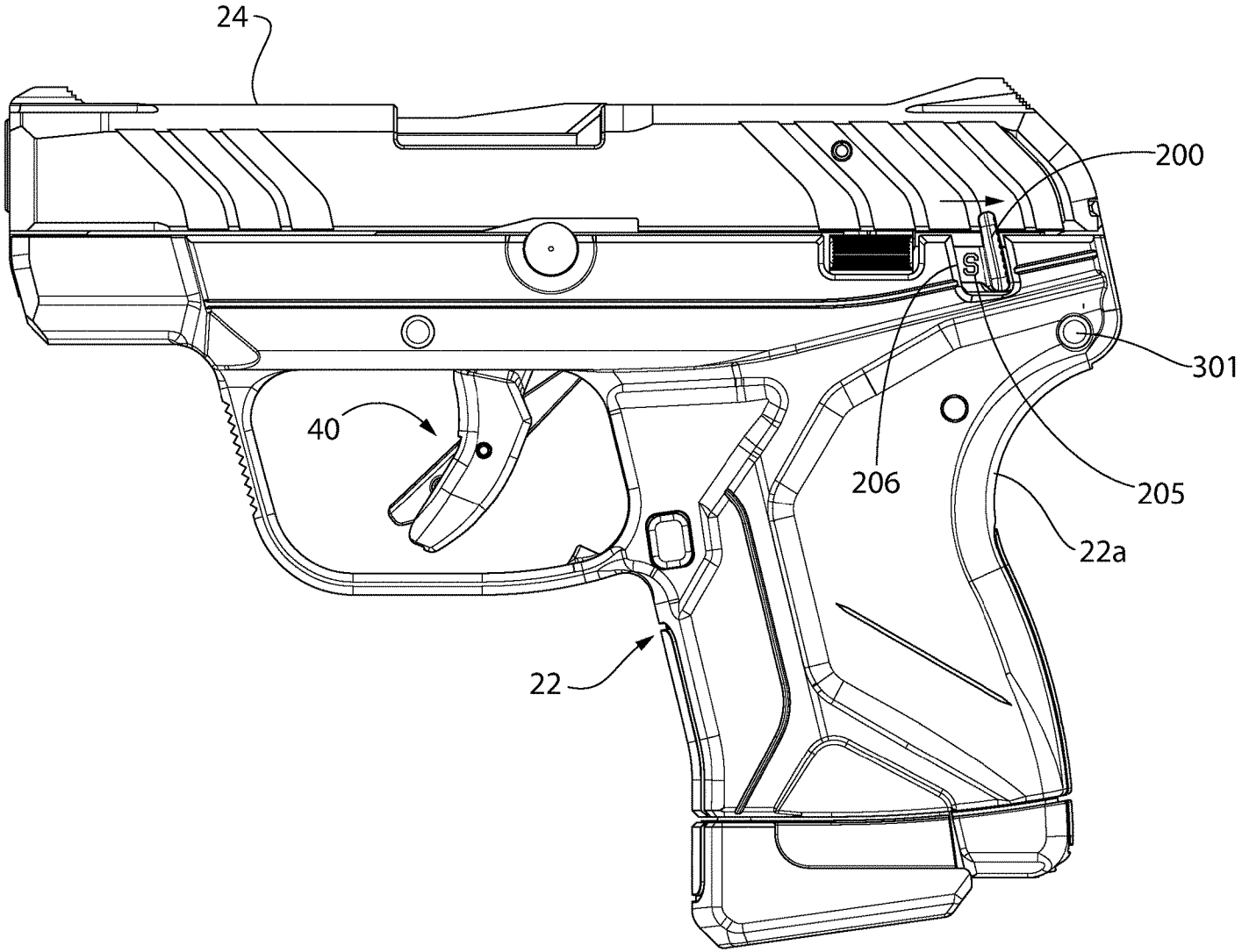
FIG. 11 is a left side elevation view thereof, the safety selector shown in the SAFE mode/position.
Figure 12:
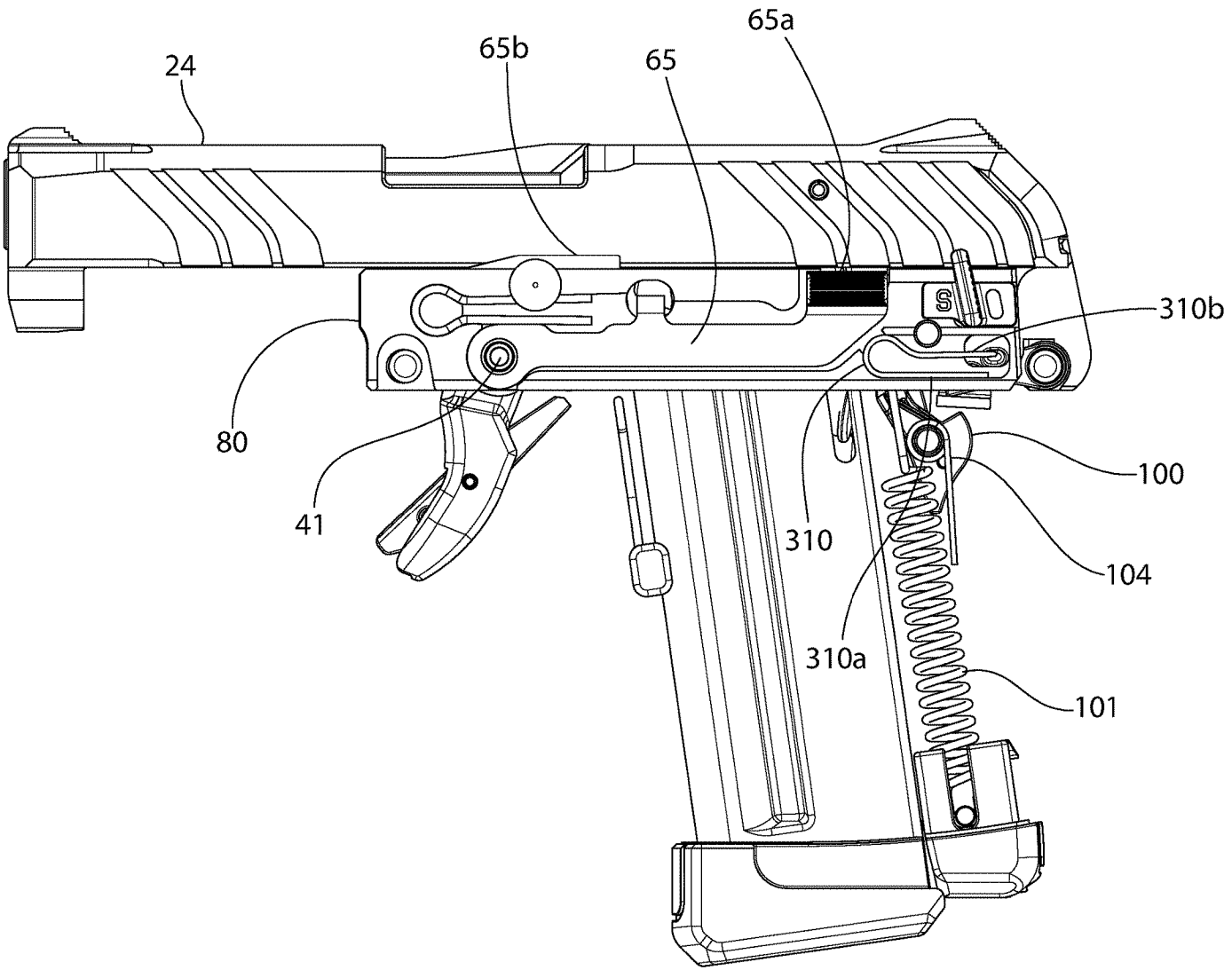
FIG. 12 is a left side view thereof; without the firearm frame.
Figure 13:
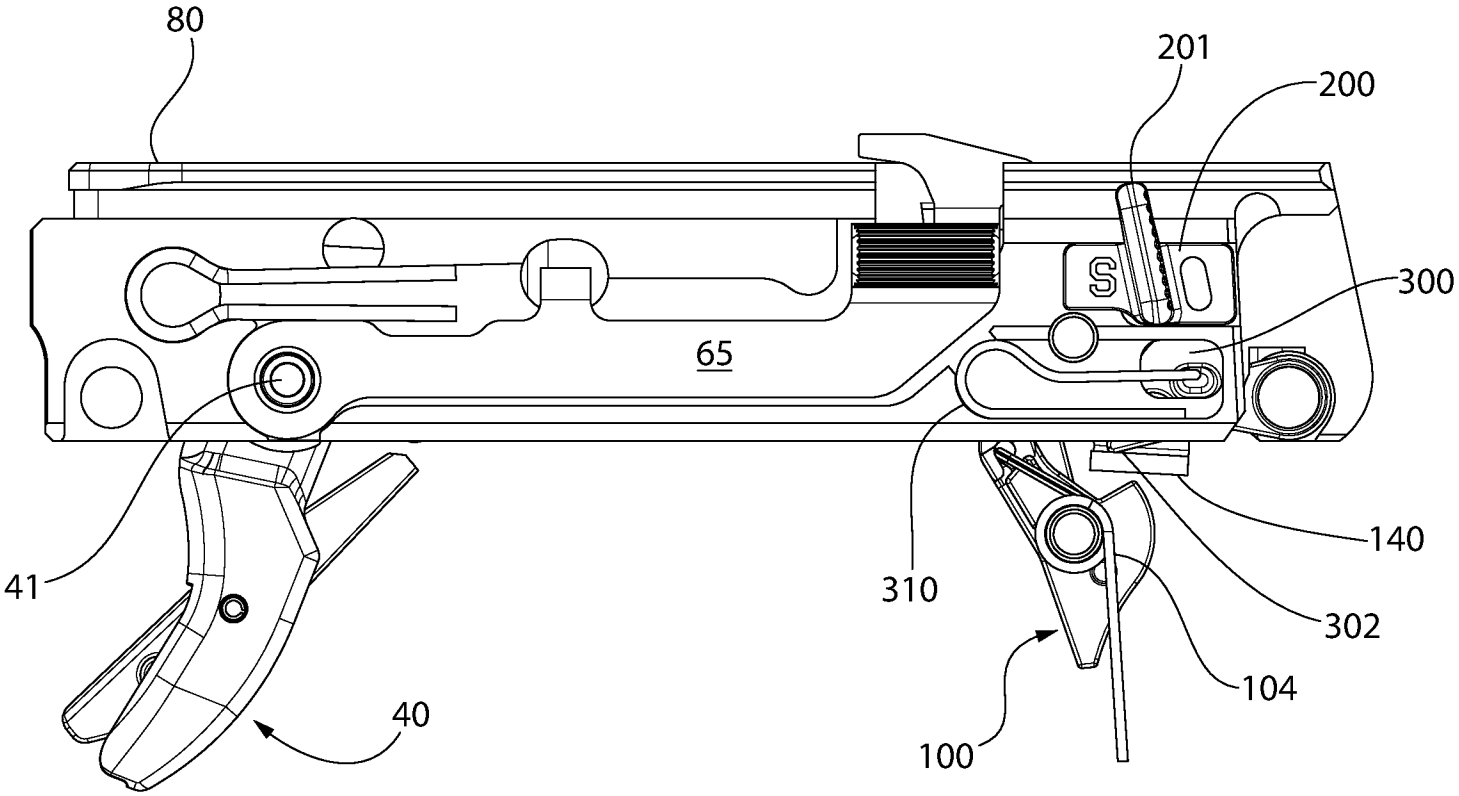
FIG. 13 is a left side view of the firing control housing insert of the firearm of FIG. 1 showing firing and safety mechanism components.

Referring to the foregoing figures, the primary safety mode selector or actuator 200 comprises a cam operated trigger bar linkage disconnect feature which acts in concert with secondary safety link 300 to misalign the interface between the sear and trigger bar such that a trigger pull with the safety activated fails to actuate the sear to release the hammer and fire the firearm. Actuator 200 in one non-limiting embodiment has a body including a substantially flat plate-like central portion 202, an actuating member 201 disposed on one lateral side (e.g. left side) of the central portion, and a rod-like camming protrusion 203 on the opposite lateral side (e.g. right side) of the central portion. Plate-like central portion 202 may be vertically oriented and axially elongated in the direction of longitudinal axis LA having a greater length than height or lateral thickness in one non-limiting configuration. The central portion may include position indicia 205 (best shown in FIG. 26C) to alert the user as to whether the safety is in the SAFE mode or position, or FIRE mode or position. The indicia may be any suitable alphanumeric character(s) and/or geometric shape alone or in combination. The indicia may have a contrasting color to the color of the central portion so as to be readily discernible. FIG. 4 shows the safety and concomitantly firing mechanism in the FIRE position in which only the FIRE indicia (oval) is visible in a window 206 formed in frame 22 through which the actuating member 201 projects laterally and upwards. The SAFE indicia ("S") is occluded by the frame 22 forward of the window. FIG. 11 shows the safety and concomitantly firing mechanism in the SAFE position in which only the SAFE indicia ("S) is visible in the window. The FIRE indicia is hidden behind the frame when the actuator 200 is slid rearwards to activate the safety.

Actuating member 201 is configured grasping by a user and operable for sliding the actuator 200 fore and aft (forward/rearward) in the frame 22 by the user and may extend perpendicularly and laterally outwards from the central portion. Actuating member 201 may have a vertically elongated height greater than the height of the central portion to facilitate engagement by the user's fingers/thumbs. Textured or undulated surface grip features 201*a* (e.g. ridges, grooves, knurling, serrations, etc.) may be provided in one embodiment on one or both of the front and rear sides of the actuating finger to ensure positive engagement by the user to activate or deactivate the safety by sliding the safety forward or rearward, as further described herein.

The camming protrusion 203 extends perpendicularly and laterally outwards from the central portion 202. Camming protrusion 203 is laterally elongated in length and arranged to engage the secondary safety link 300. The camming protrusion may have an oblong cross section shape having a greater longitudinal width than a height (best shown in FIGS. 26B and 26D). Camming protrusion 203 is arranged and operable to slideably engage a corresponding camming surface 313 formed on the safety link 300 (see, e.g. FIGS. 21-23 and 27A-D). Camming surface 313 may be arcuately curved and axially elongated in one embodiment. A generally V-shaped locking projection 203*a* is disposed on the lower portion of the camming protrusion which selectively engages a mating inverse complementary configured V-shaped locking notch 204 formed on the secondary safety link 300 (see, e.g. FIGS. 21-23 and 27B). This positively but removably locks the actuator camming protrusion 203 in position on the safety link 300. Locking protrusion 203*a* depends downwards from camming protrusion 203 and may extend for the full lateral length of the camming extension in some embodiments as illustrated. In one embodiment, as best shown in FIGS. 27A-D, the camming surface 313 may be disposed on an upper surface of the hammer blocking nose protrusion 305 protrusion of the safety link 300 further described below. The notch 204 may be located at one end (e.g. top end as illustrated) of the camming surface. The foregoing features of actuator 200 described above may be integrally formed as unitary structural parts of the safety.

Figure 5:
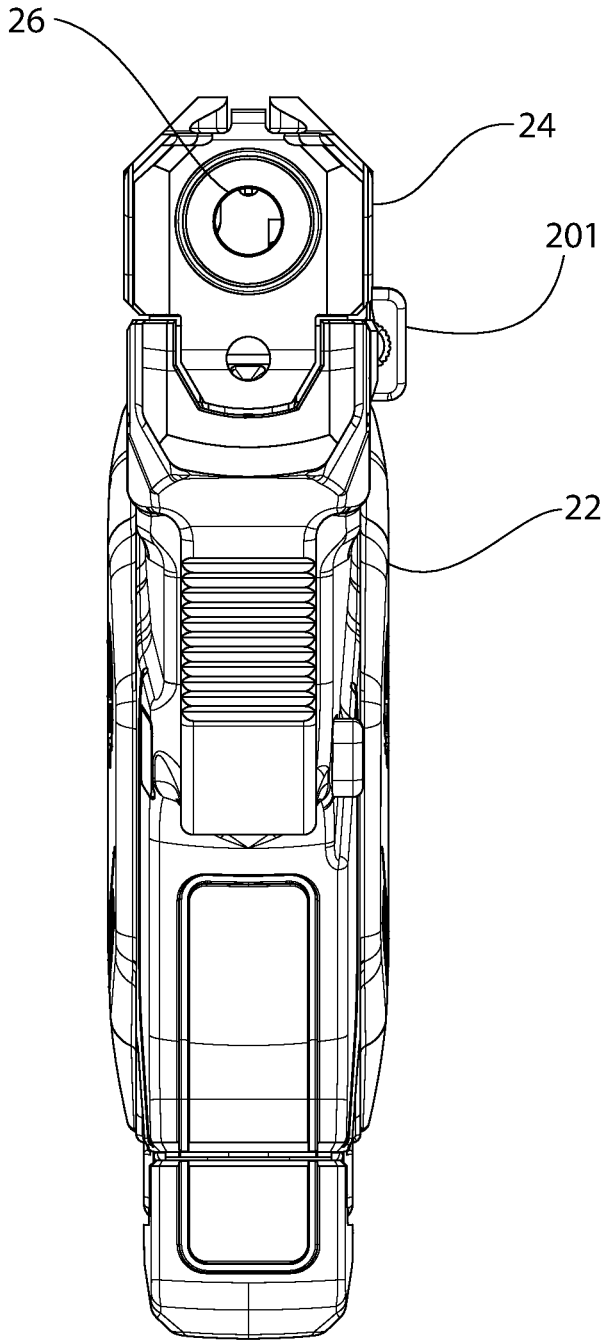
FIG. 5 is a front view thereof.
Figure 6:
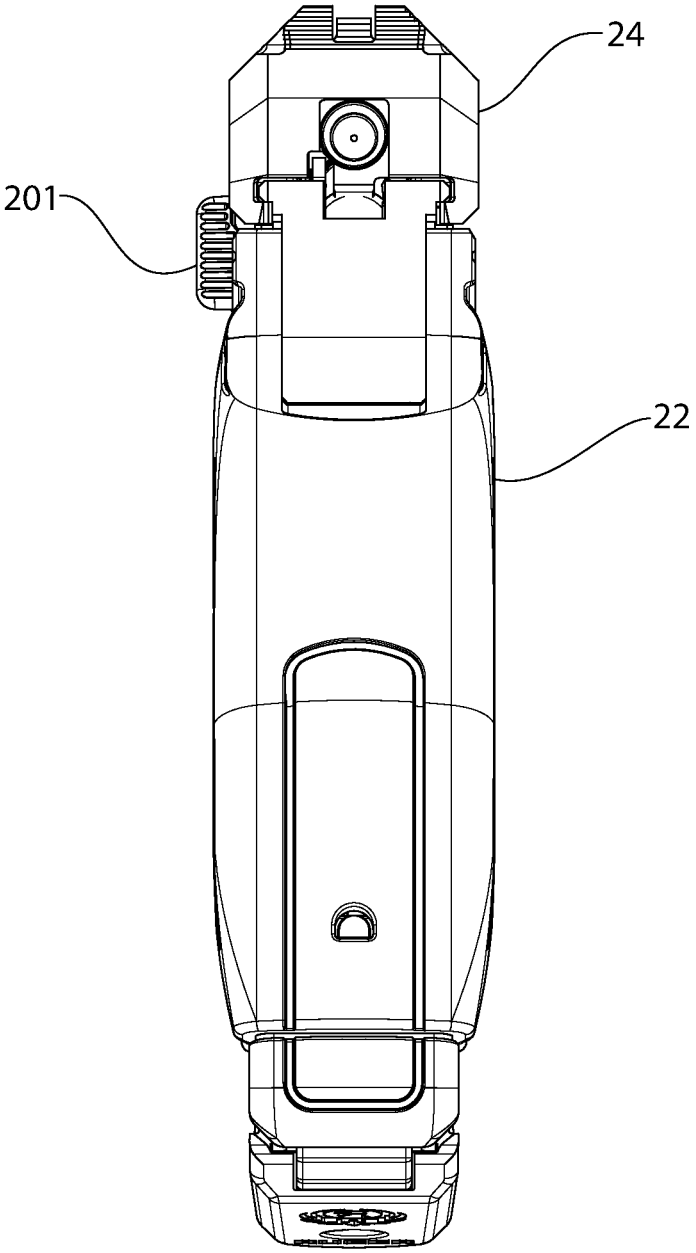
FIG. 6 is a rear view thereof.

The actuator 200 is captured between firing control housing insert 80 and outer pistol frame 22. Actuator 200 is linearly and slideably movable in the axial direction of the longitudinal axis LA between a forward FIRE position (FIG. 4) and a rearward SAFE position (FIG. 5). These positions may be considered to represent the positions of the firearm safety mechanism in general as the actuator via interaction with the secondary safety link controls the operating mode of the safety mechanism and firing mechanism.

Secondary safety link 300 is configured to act directly on the trigger bar 42 and hammer 60 when actuated by the camming protrusion 203 of actuator 200. Safety link 300 comprises a body including a top 308, bottom 309, left lateral side 306 disposed proximate to the left side of pistol 20, and a right lateral side disposed near the right side of the pistol. Safety link 300 includes rear extending mounting portion 303, and front operating portion 304. Mounting portion 303 has a transverse through opening 304 which receives transversely mounted pivot pin 301 therethrough defining a transverse pivot axis of the safety link oriented perpendicularly to longitudinal axis LA. The safety link pivot axis may be located rearward of both the transverse pivot axes of the hammer 60 and sear 100. The opening 304 may be located at the very rear end of the mounting portion 303 as shown in the illustrated embodiment. The front operation portion 304 of the safety link is pivotably up and down about its rear pivot axis for selectively enabling or disabling the firing mechanism, as further described herein. In one embodiment, the rear mounting portion 303 is offset towards the left lateral side of the safety link 200 and the firearm, and therefore does not have a lateral width which extends completely across the firearm from side to side (best shown in FIG. 27G).

The front operating portion 304 however may have a lateral width in one embodiment which extends transversely completely across the firearm from left to right side. Operating portion 304 includes a pair of safety protrusions comprising trigger bar actuating foot protrusion 302 on the right lateral side 307 of safety link 300 and a hammer blocking nose protrusion 305 on the left lateral side 306. Cross member 308 extends transversely between the foot protrusion and nose protrusion which structurally links them together. The nose protrusion and foot protrusion may project forwardly and perpendicularly from the cross member towards the front of the firearm (i.e. barrel end). The operating and mounting portions 303, 304 of the safety link 300 and features thereon may be integrally formed as unitary structural parts of the monolithic safety link.

Figure 20:
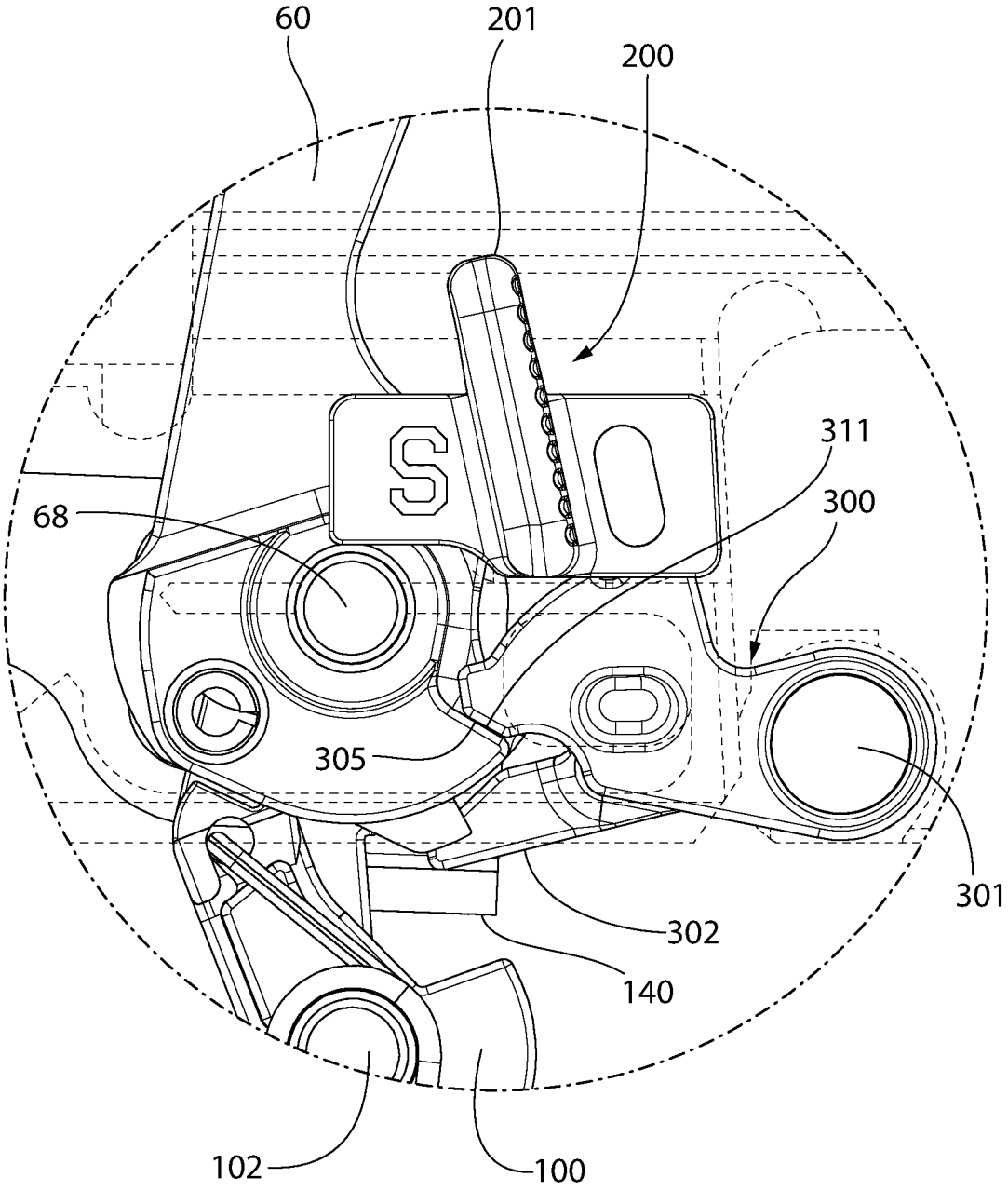
FIG. 20 is an enlarged detail from FIG. 19.
Figure 21:
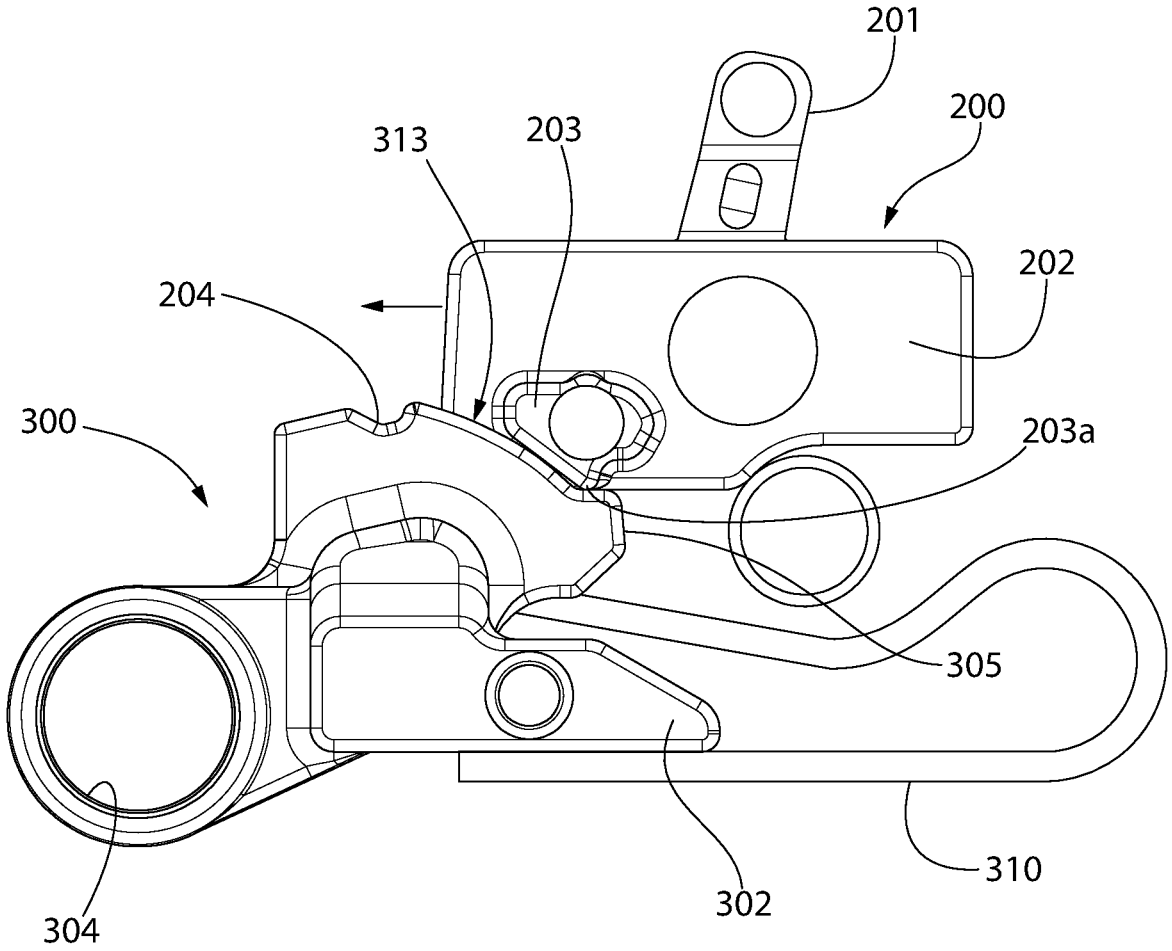
FIG. 21 is a right side view of the firing mechanism in a first operating position.
Figure 22:
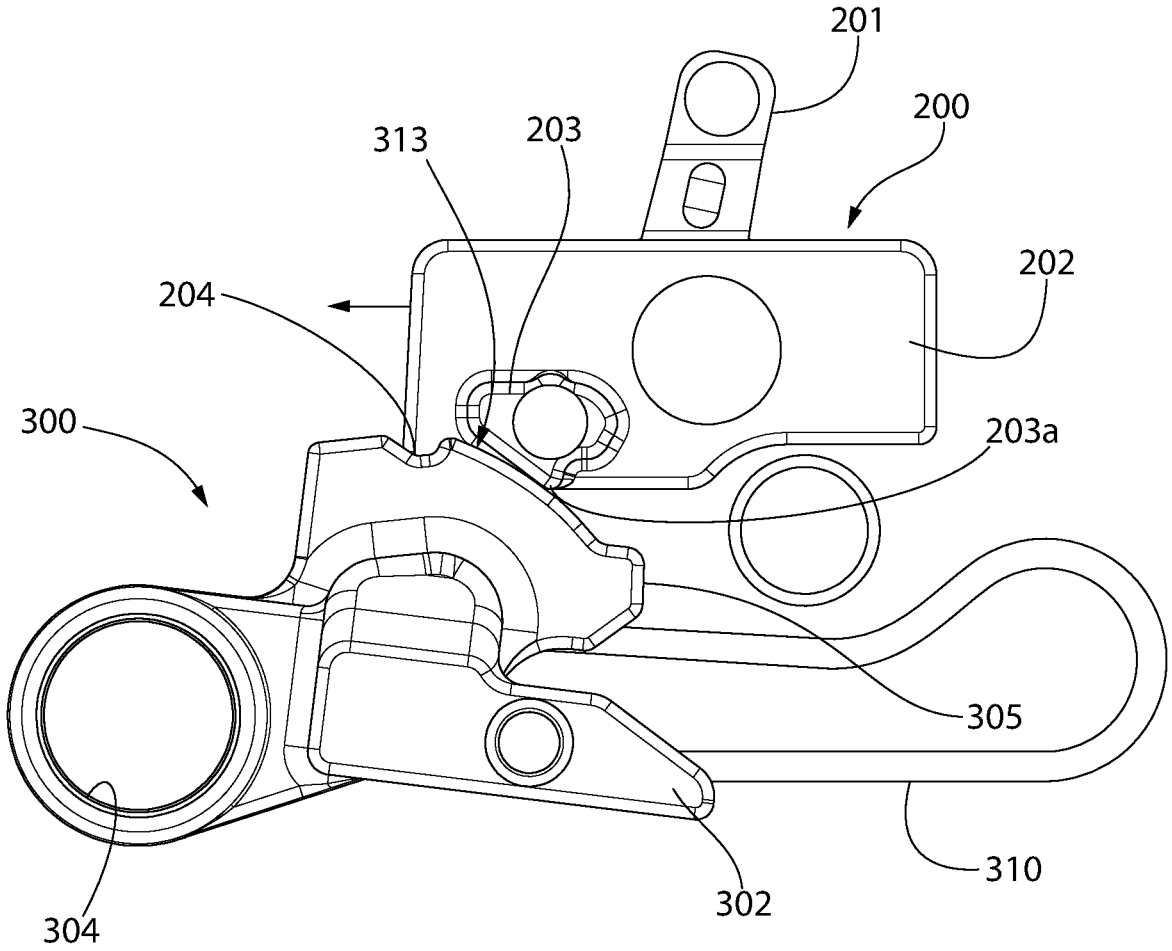
FIG. 22 is a right side view of the firing mechanism in a second sequential operating position.
Figure 27A:
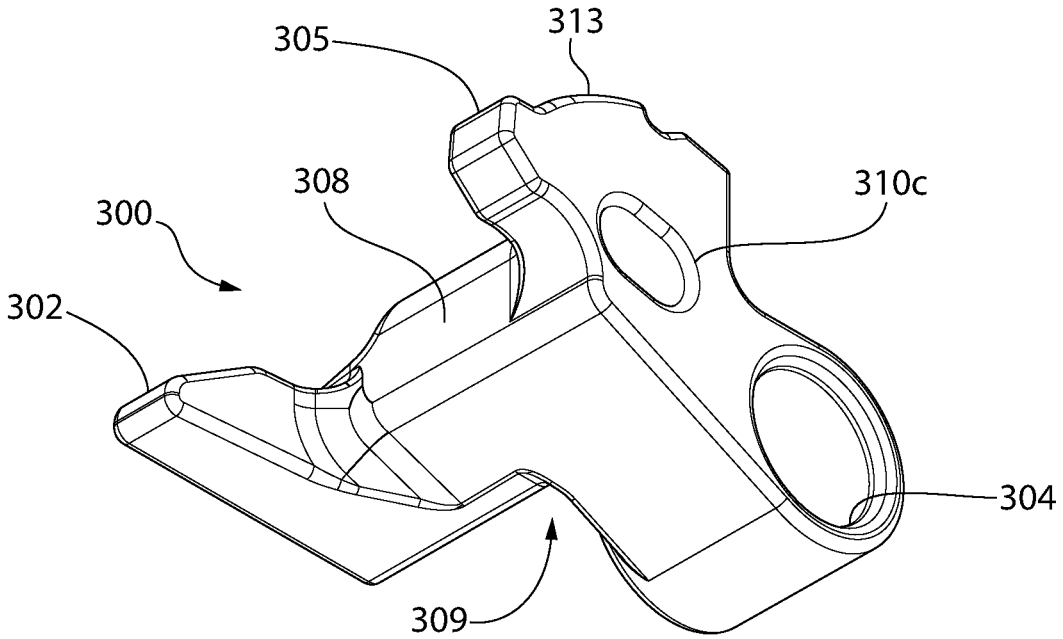
FIG. 27A is a front bottom perspective view of the safety link of the safety mechanism.
Figure 27B:
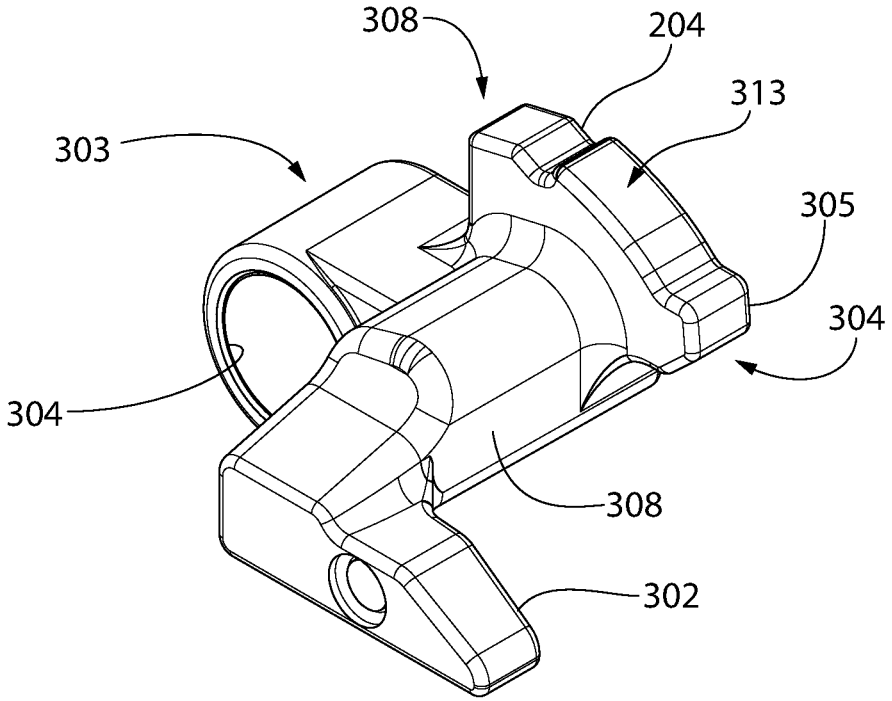
FIG. 27B is a front top perspective view thereof.
Figure 27C:
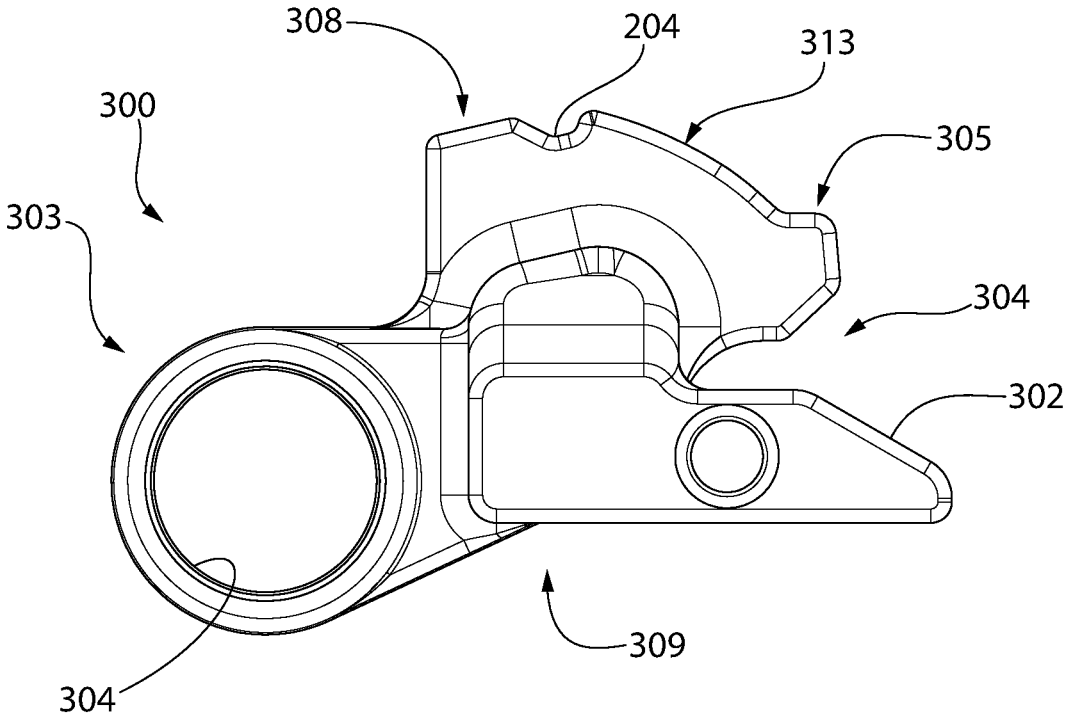
FIG. 27C is a right side view thereof.
Figure 27D:
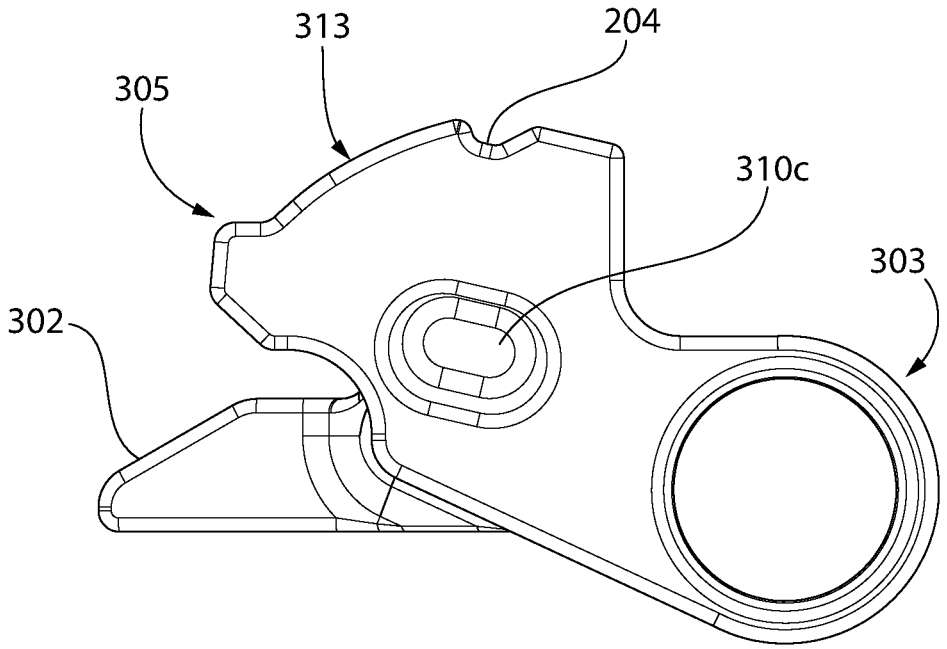
FIG. 27D is a left side view thereof.
Figure 27E:
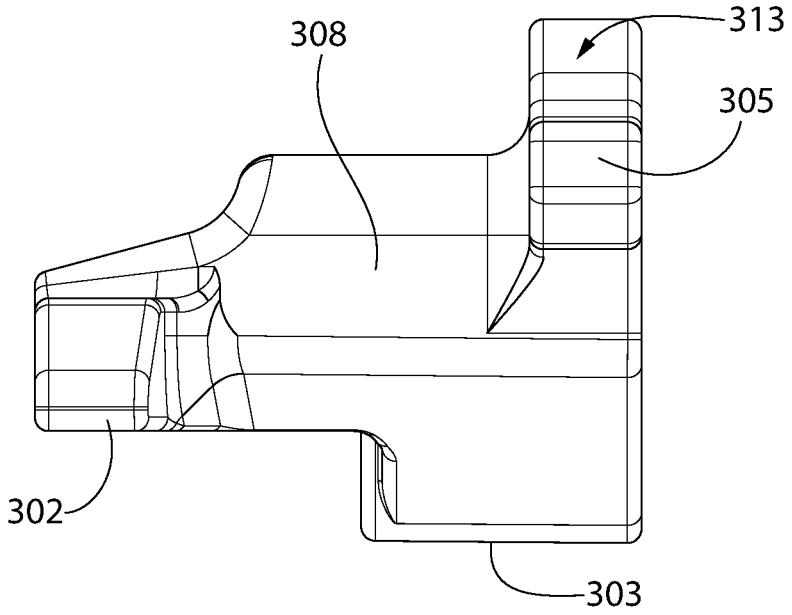
FIG. 27E is a front view thereof.
Figure 27F:
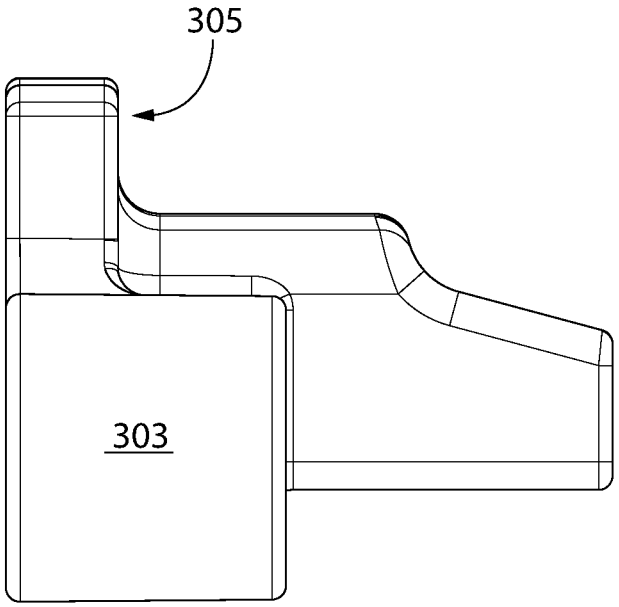
FIG. 27F is a rear view thereof.
Figure 27G:
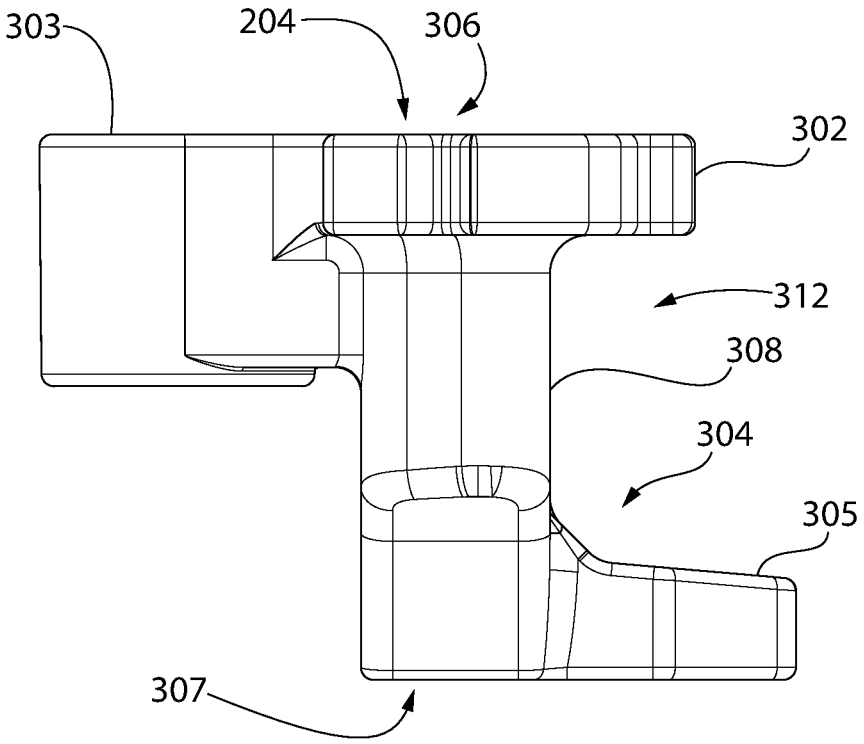
FIG. 27G is a top view thereof.
Figure 27H:
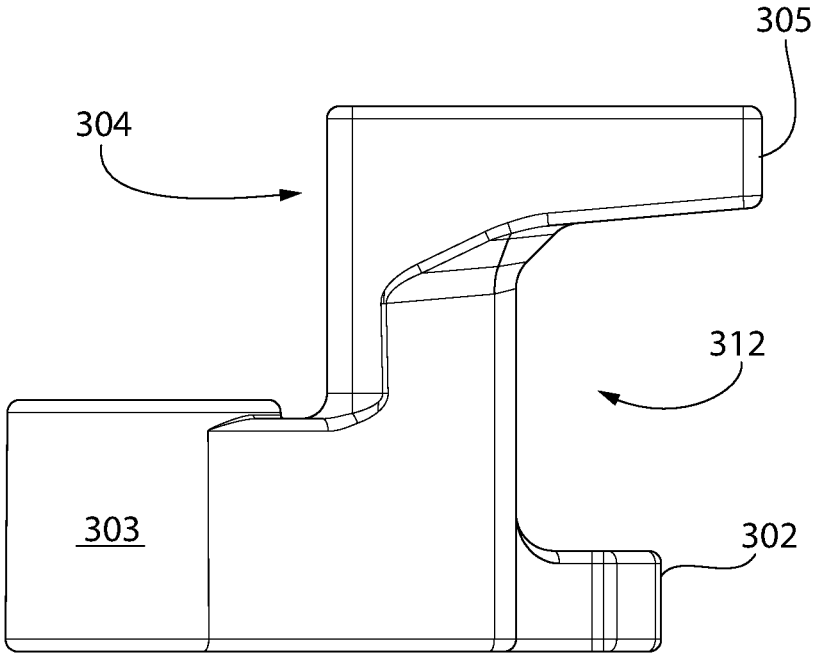
FIG. 27H is a bottom view thereof.

The trigger bar actuating foot protrusion 302 of safety link front operating portion 304 is configured and operable to selectively engage the top surface of the laterally extending trigger bar operating protrusion 140 when the safety link is actuated by the actuator 200 (see, e.g. FIG. 20). The hammer blocking nose protrusion 305 is configured and operable to selective engage a rearwardly located blocking surface 311 on hammer 60 (see, e.g. FIGS. 20, 24A, and 24D). A flat-to-flat surface interface may be provided between blocking surface 311 and the mating surface on blocking nose protrusion 305 (best shown in FIG. 20) to ensure positive engagement therebetween and arrest movement of the hammer. Referring to FIG. 27G, a forwardly open lateral gap 312 is formed between the blocking nose protrusion 305 and trigger bar actuating foot protrusion 302 of safety link 300 to allow the hammer 60 to at least partially enter the gap without interference when the hammer is cocked rearwardly since the safety link is located rearward of the hammer.

Safety link 300 is pivotably movable between an upper unactuated position in which the operating portion 304 of the safety link does not engage the trigger bar 42 or hammer 60 thereby allowing the firing mechanism to discharge pistol 20 via a trigger pull, and a lower actuated position in which the operating portion engages the trigger bar and hammer via actuating foot protrusion 302 and nose protrusion 305 respectively to prevent the firing mechanism from discharging the pistol when the trigger is pulled. The safety link may be biased towards the upper position by generally U-shaped spring 310 having a lower leg 310*a* engaged with the firing control housing insert 80 and/or frame 22, and an upper leg 310*b* engaged with spring seating hole 310*c* which may be located on the left hammer blocking nose protrusion 305 in one embodiment (see, e.g. FIGS. 12 and 27A). Spring 310 may be horizontally oriented in one embodiment such that the two legs are substantially horizontal and extend rearward from the curved U-bend portion which may be located at front as shown. Other types of springs however may be used to bias safety link 300 upwards in other embodiments.

A method for operating the safety mechanism of pistol 20 according to the present disclosure will now be briefly described. FIG. 4 shows the complete firearm with safety selector or actuator 200 in the axially forward FIRE position whereas FIG. 11 shows the actuator in the axially rearward SAFE position (note "S" indicia visible through window in frame). FIGS. 12-23 show the firing and safety mechanism components without the frame of the firearm for added clarity.

Figure 14:
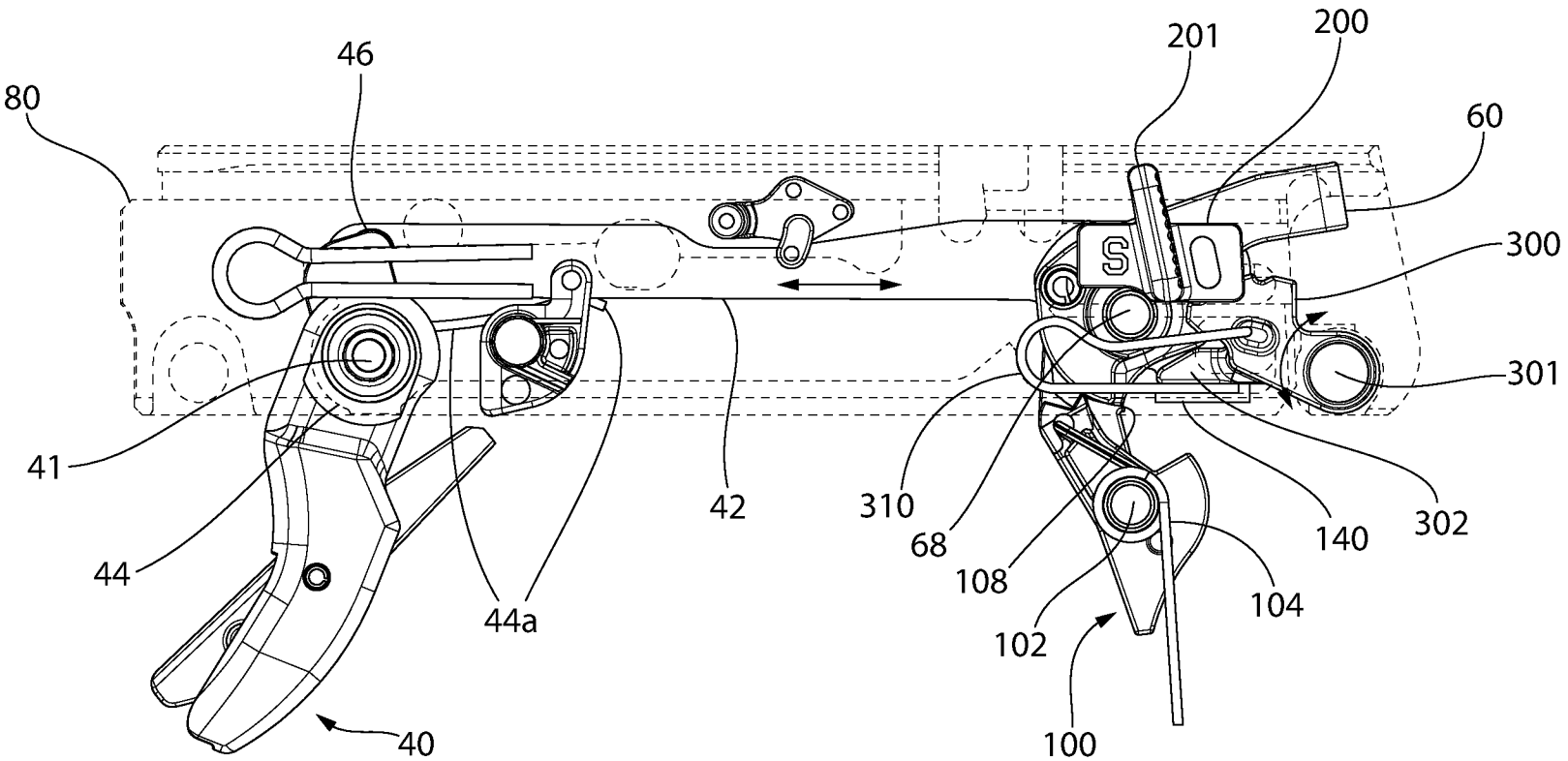
FIG. 14 is a left side view thereof showing the firing and safety mechanisms in the FIRE mode/position with trigger unpulled.

Referring now to FIG. 14, the firing and safety mechanisms are initially shown in the FIRE mode or position with the trigger unpulled. This is a ready-to-fire condition. The trigger bar operating protrusion 140 is shown axially aligned with (but spaced rearward from) the mating sear operating protrusion 108. The operating protrusions 140, 108 therefore lie in the same plane and linear path of travel which would allow the firearm to be discharged when the trigger 40 is pulled. As the trigger is pulled shown in FIG. 16 while still in the FIRE mode, the trigger bar 42 moves axially forward as the trigger is pulled rearward. The trigger bar operating protrusion 140 advances forward to engage the sear operating protrusion 108. The sear rotates forward and breaks contact with the hammer 60 in the manner previously described herein. The hammer fully rotates and strikes the firing pin 27 to discharge the pistol 20.

Figure 23:
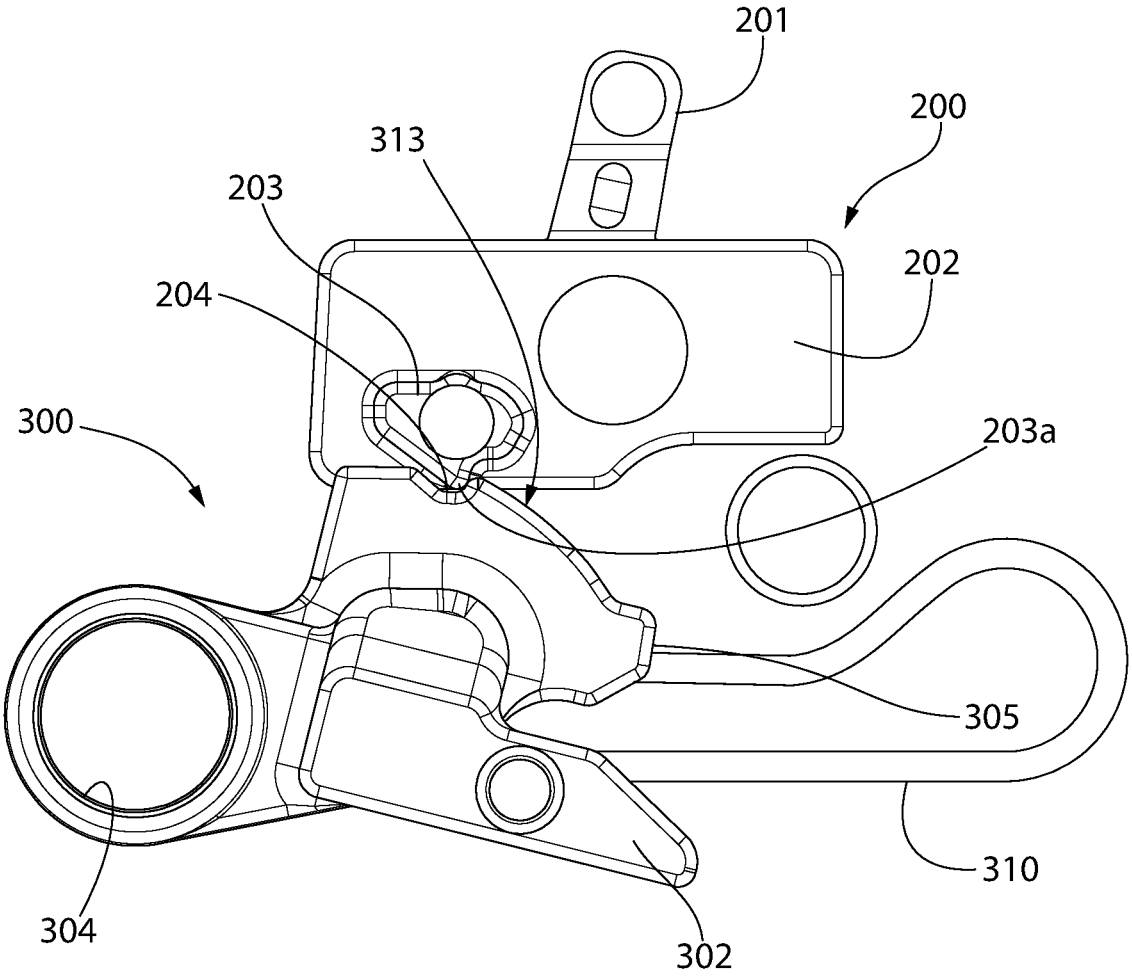
FIG. 23 is a right side view of the firing mechanism in a third sequential operating position.
Figure 24B:
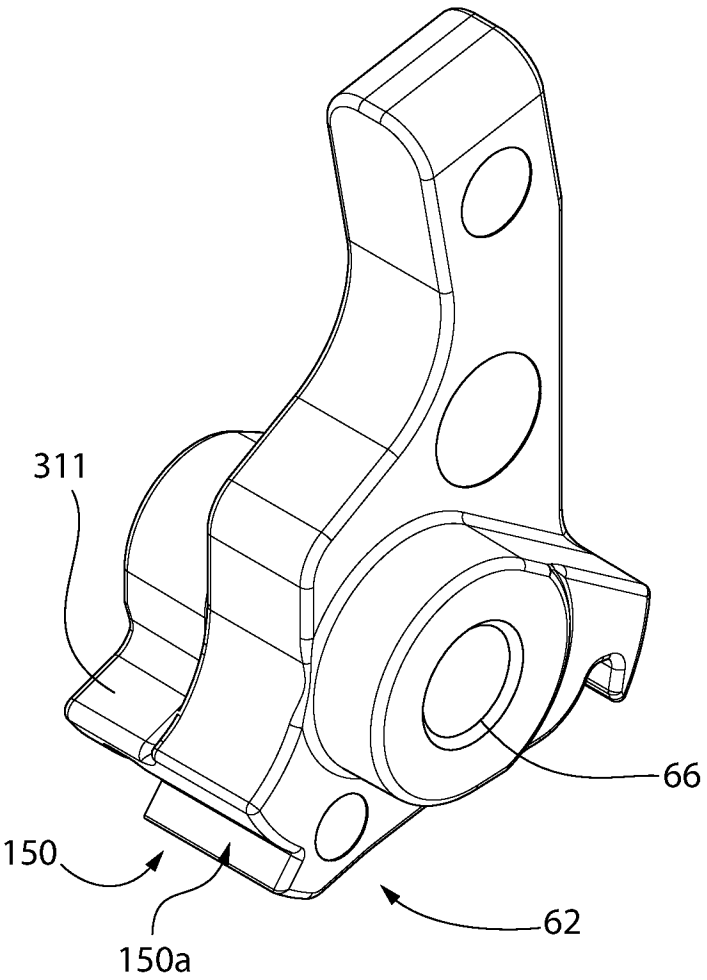
FIG. 24B is a rear perspective view thereof.
Figure 24A:
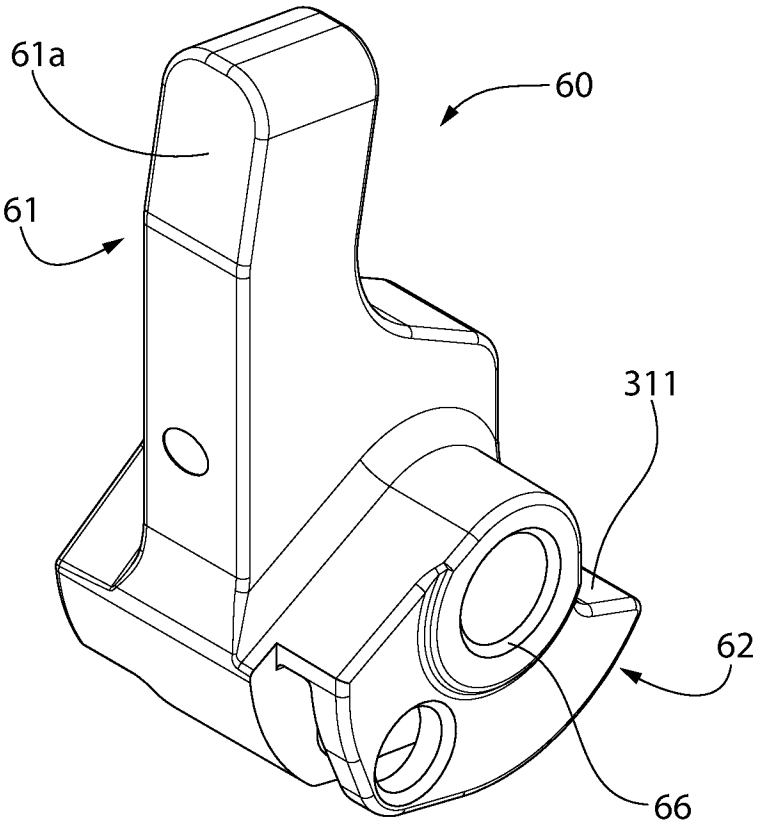
FIG. 24A is a front perspective view of the hammer.
Figure 24D:
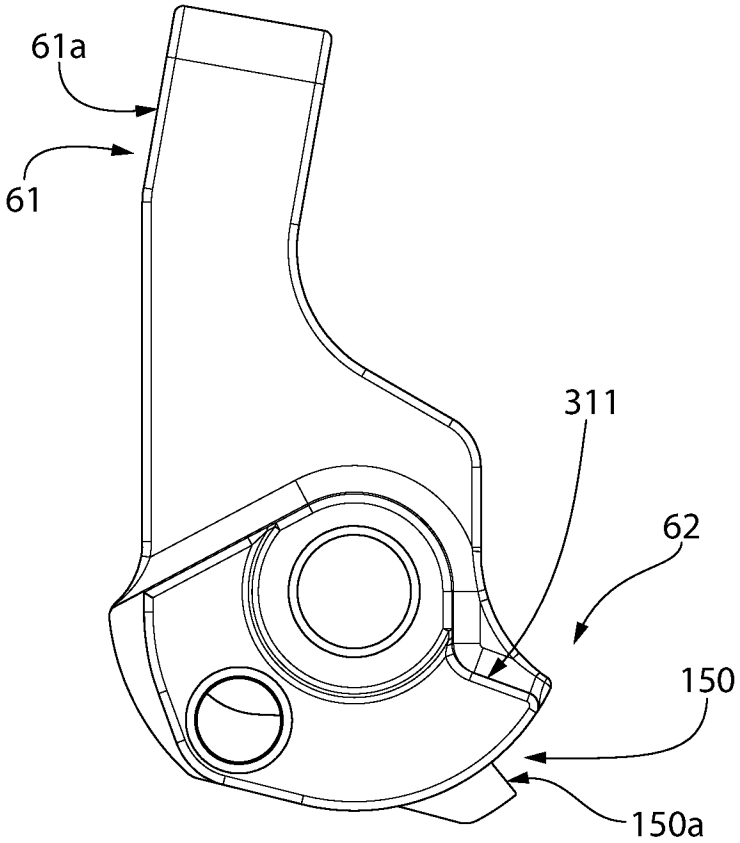
FIG. 24D is a left side view thereof.
Figure 24C:
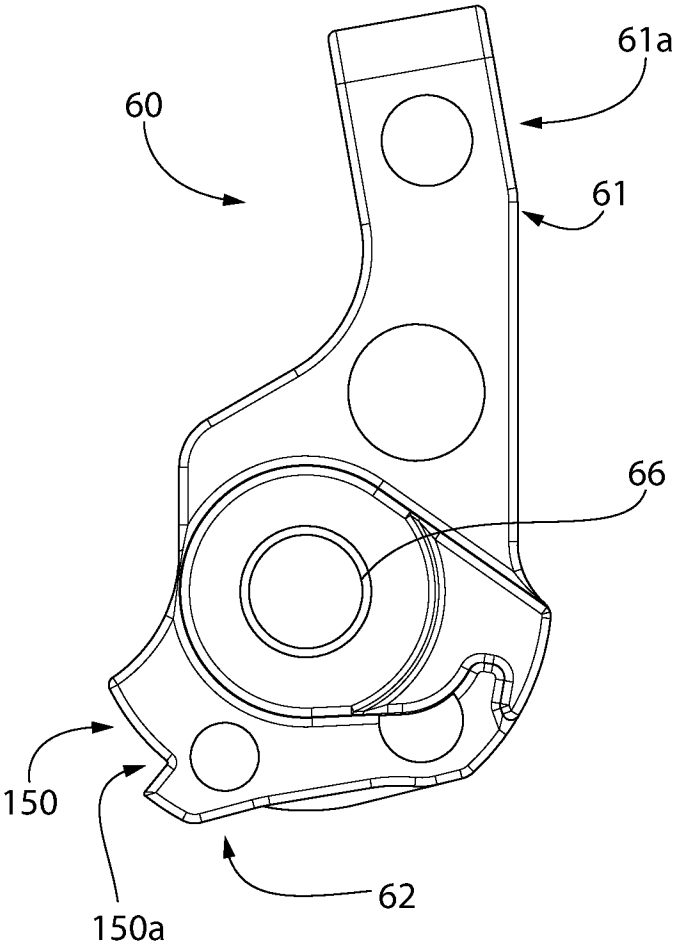
FIG. 24C is a right side view thereof.
Figure 25B:
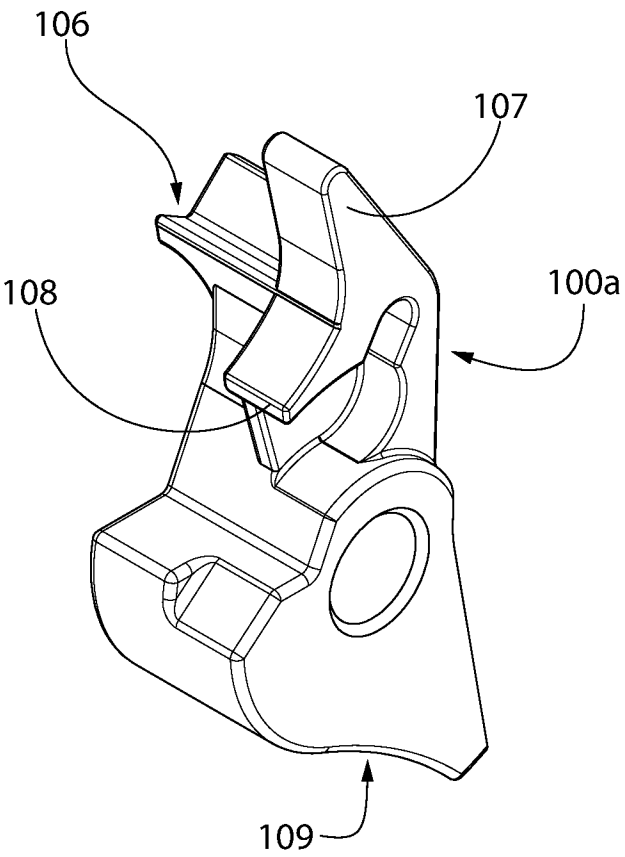
FIG. 25B is a front perspective view thereof.
Figure 25A:
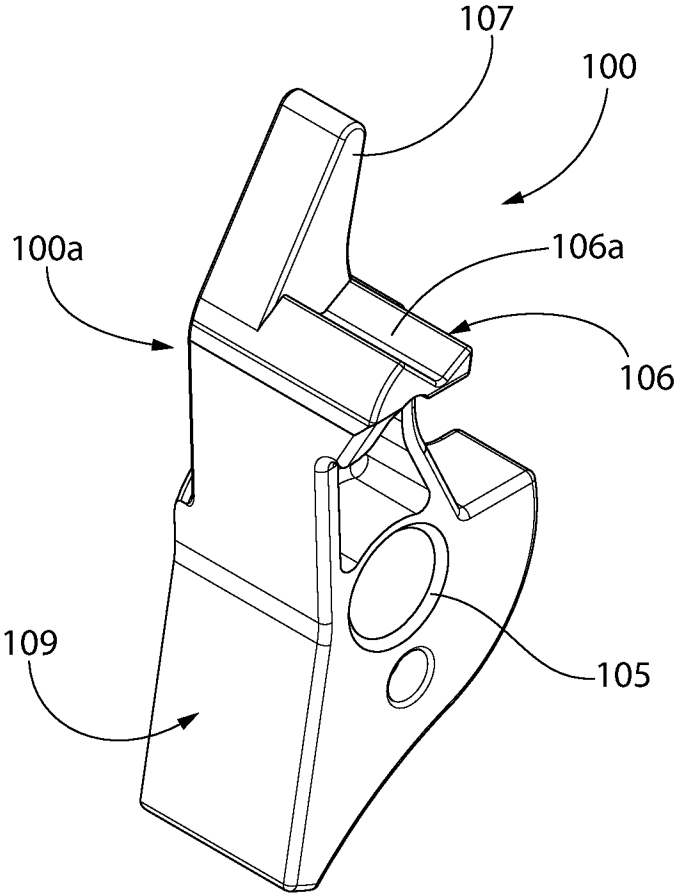
FIG. 25A is a rear perspective view of the sear.
Figure 25D:
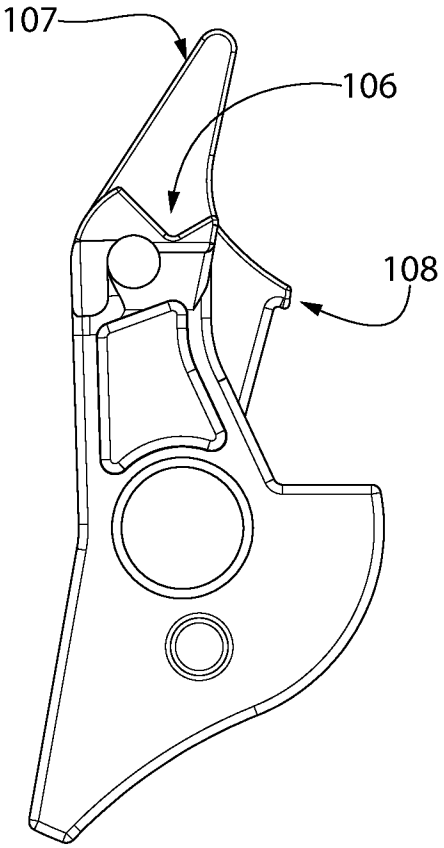
FIG. 25D is a right side view thereof.
Figure 25C:
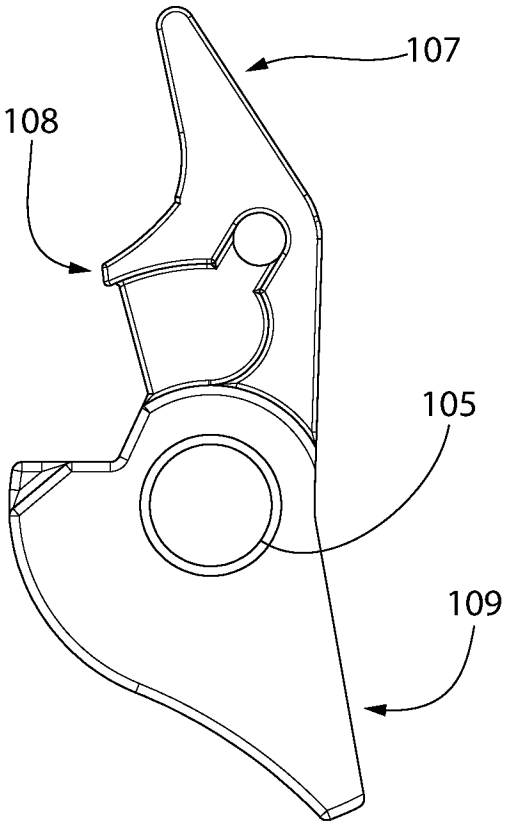
FIG. 25C is a left side view thereof.
Figure 26A:
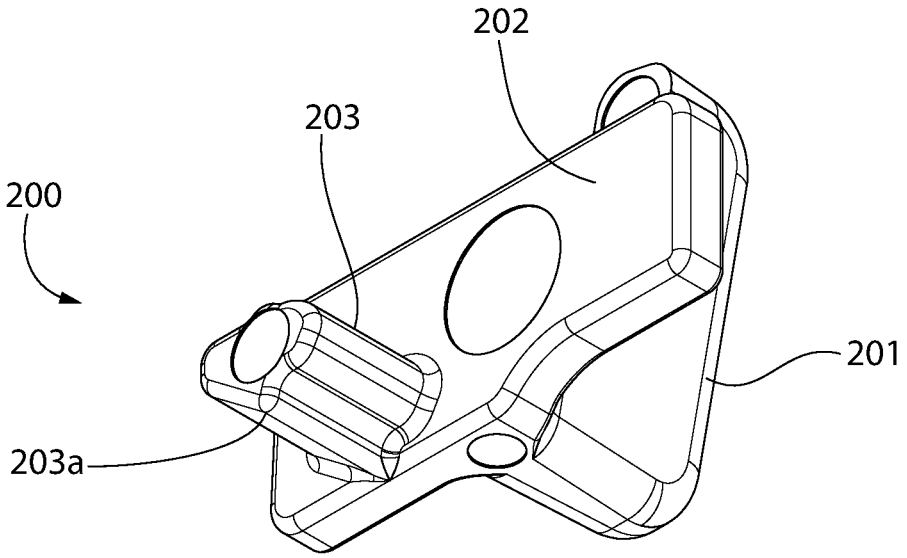
FIG. 26A is a right front bottom perspective view of the safety selector of the safety mechanism.
Figure 26B:
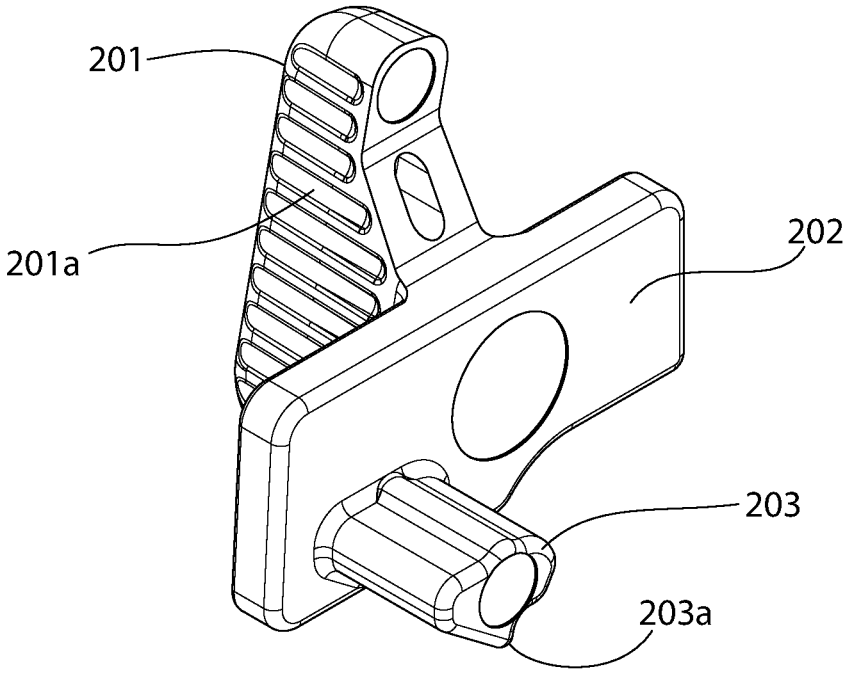
FIG. 26B is a right rear top perspective view thereof.
Figure 26C:
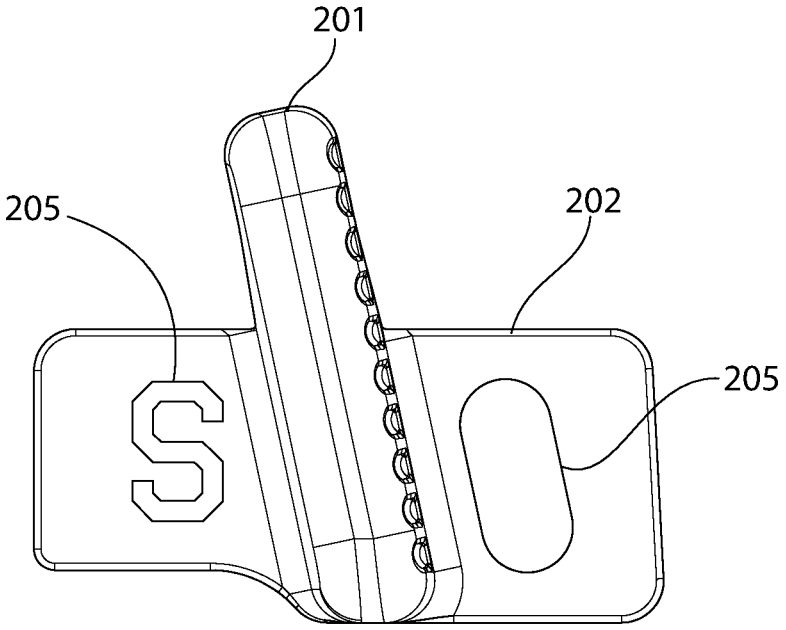
FIG. 26C is a left side view thereof.
Figure 26D:
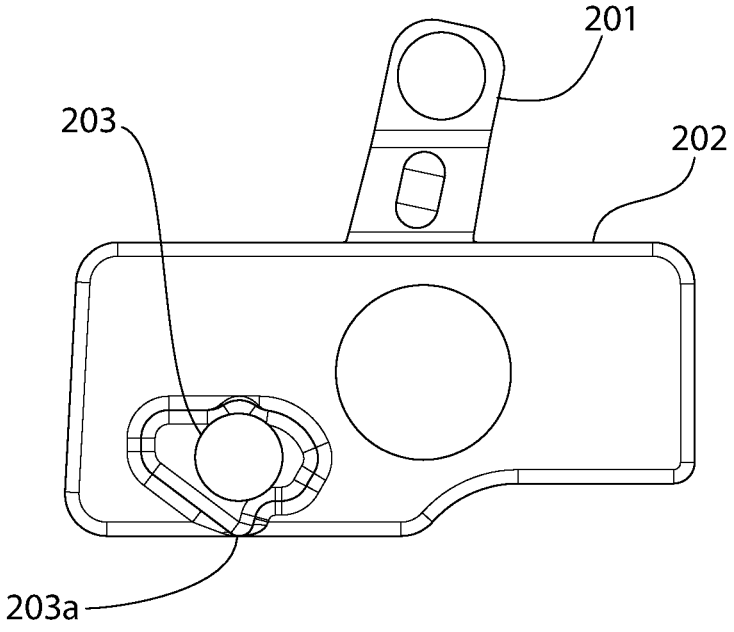
FIG. 26D is a right side view thereof.
Figure 26E:
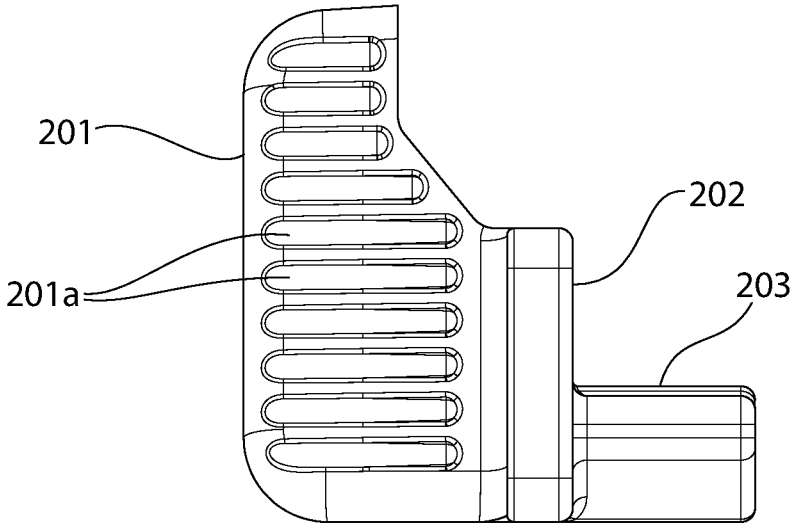
FIG. 26E is a rear view thereof.
Figure 26F:
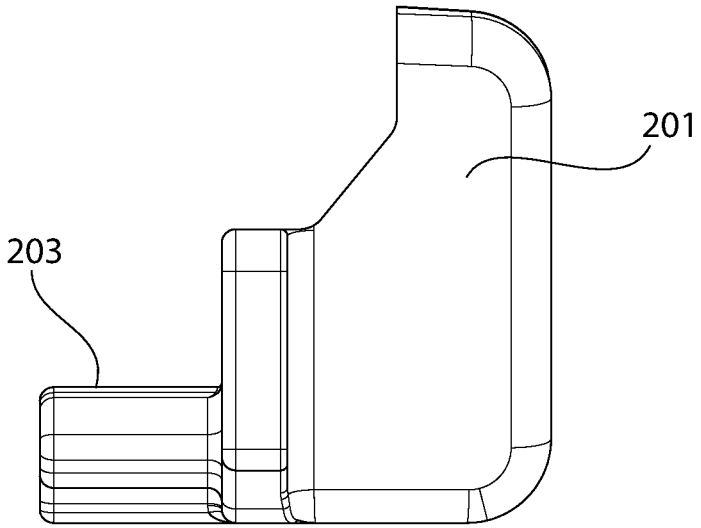
FIG. 26F is a front view thereof.
Figure 26G:
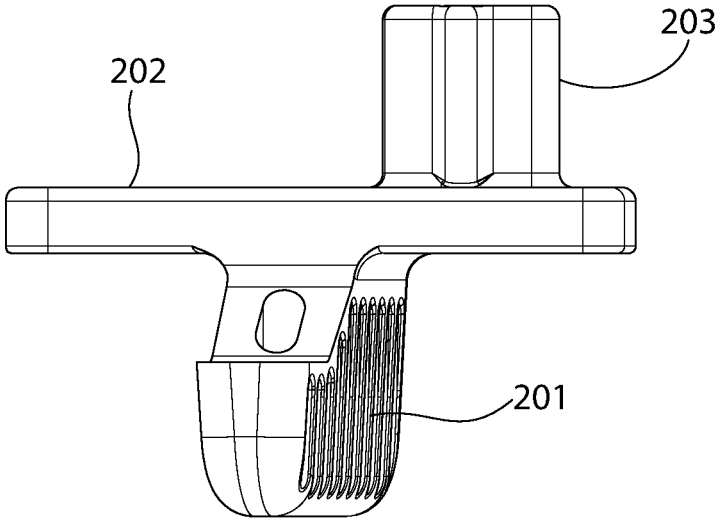
FIG. 26G is a top view thereof.
Figure 26H:
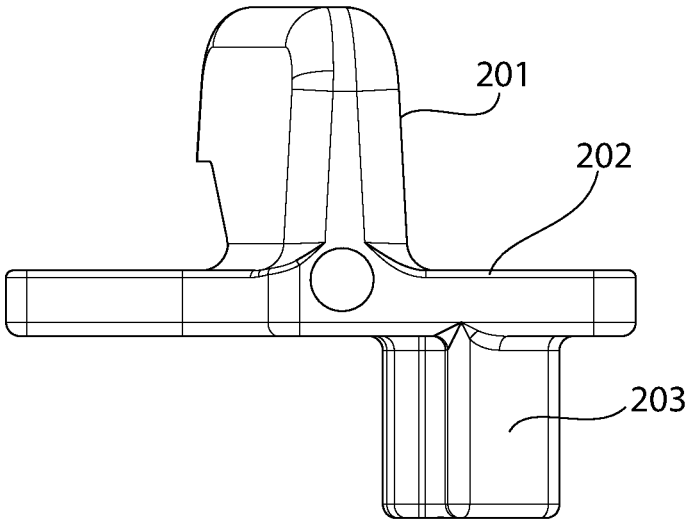
FIG. 26H is a bottom view thereof.

To activate the safety mechanism, the selector or actuator 200 is manually slid by the user linearly rearward to the position shown in FIGS. 12-13, 15, and 19. The camming protrusion 203 slideably engages curved cam surface 313 on safety link 300 which forces the front operating portion 304 of the safety link to rotate downwards about the rear pivot axis defined by pivot pin 301 extending transversely through the mounting portion 303 of the safety link. The camming protrusion progressively advances forward along the cam surface 313 while maintaining contact therewith to drive the mounting portion further down as the actuator 200 is moved rearward to the full SAFE mode/position. This is shown sequentially in FIGS. 21-23. The V-shaped locking projection 203*a* eventually engages a mating inverse complementary configured V-shaped locking notch 204 formed on the secondary safety link 300 at the front end of the camming surface 313 (FIG. 23).

The foot protrusion 302 of the safety link 300 rotates downward engaging the trigger bar operating protrusion 140 which concomitantly forces and displaces the trigger bar vertically downwards from an upper aligned position to a lower misaligned position (see also FIG. 20). Trigger bar operating protrusion 140 is no longer axially aligned with or lies in the same plane as sear operating protrusion 108 (compare FIG. 17 showing axially aligned position and FIG. 18 showing axially misaligned position). When the trigger is pulled, the trigger bar will move forward but cannot engage and actuate the sear 100 to discharge the pistol. As shown in FIG. 20, the nose protrusion 305 of the safety link has simultaneously moved downward to engage blocking surface 311 on the hammer 60 to arrest its movement. While in the SAFE position, the safety link prevents the hammer from ever reaching full rotation necessary to reach and strike the firing pin. The dual-acting safety mechanism is now fully engaged to disable the firing mechanism in two different ways all via the single sliding motion of the safety selector or actuator 200. It also bears noting the dual-acting safety makes it more difficult for an end user to attempt to defeat the safety by improperly and inadvisably modifying the firearm.

Figure 15:
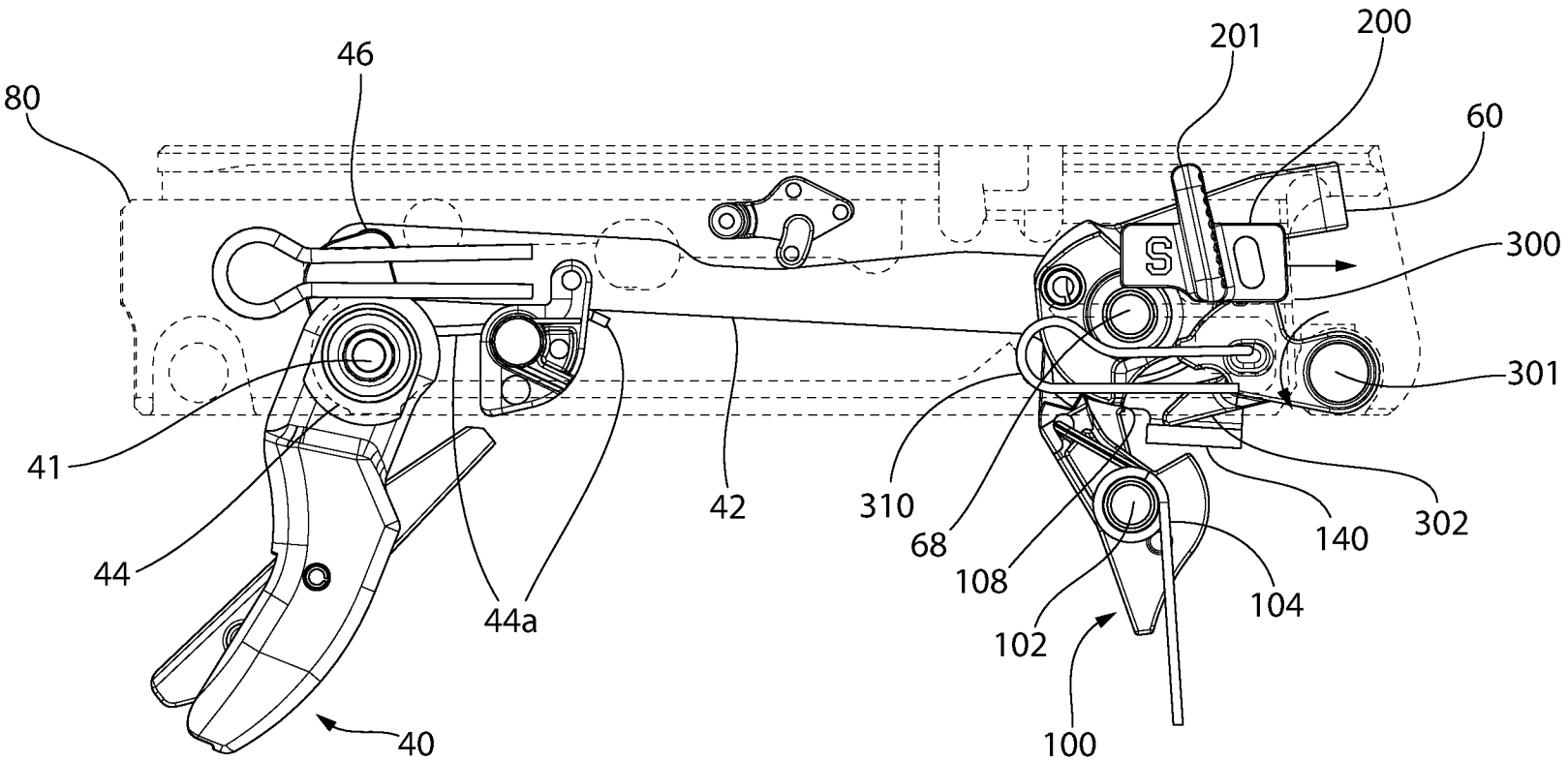
FIG. 15 is a left side view thereof showing the firing and safety mechanisms in the SAFE mode/position with trigger unpulled.
Figure 16:
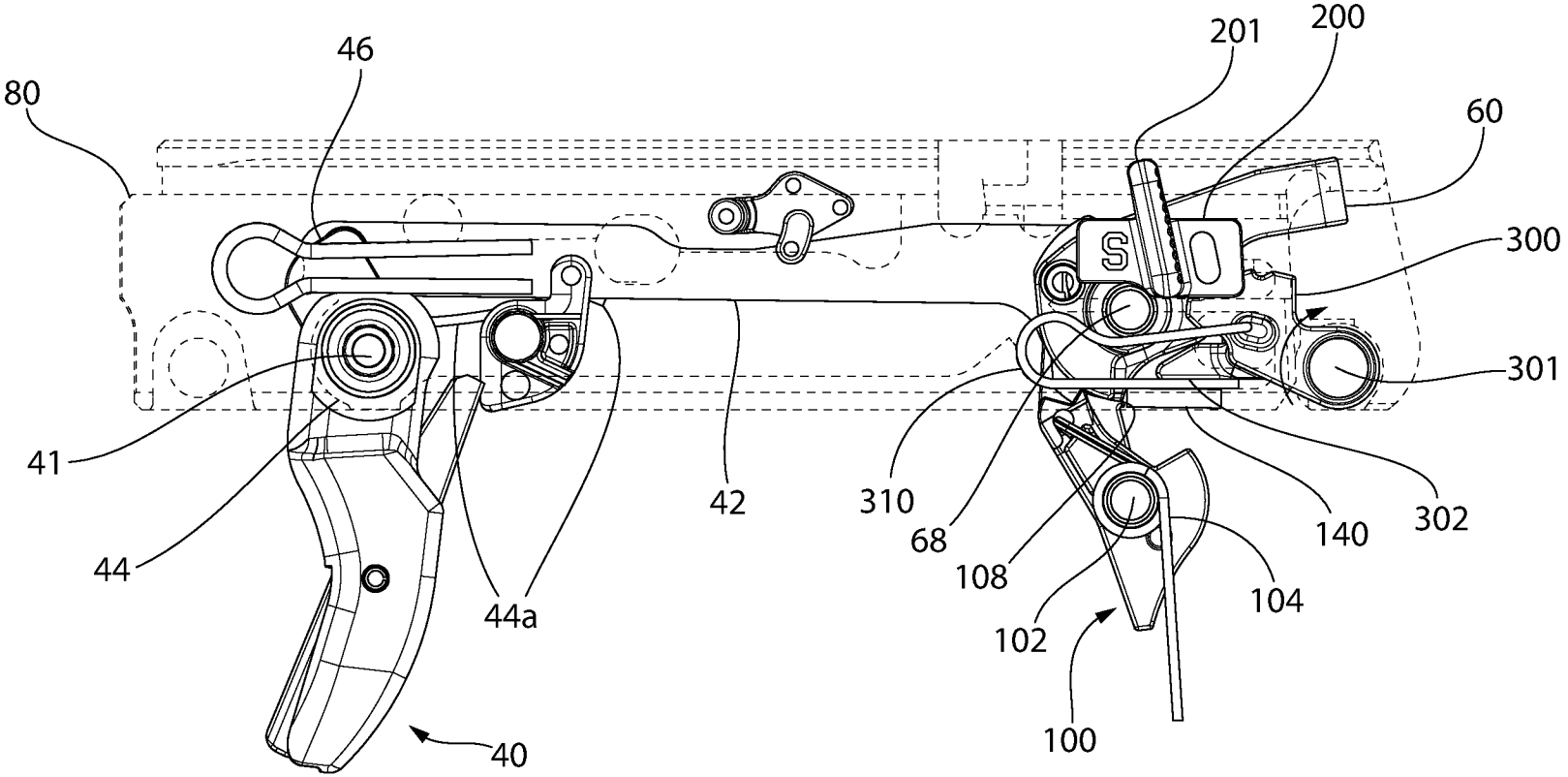
FIG. 16 is a left side view thereof showing the firing and safety mechanisms in the FIRE mode/position with trigger pulled.
Figure 19:
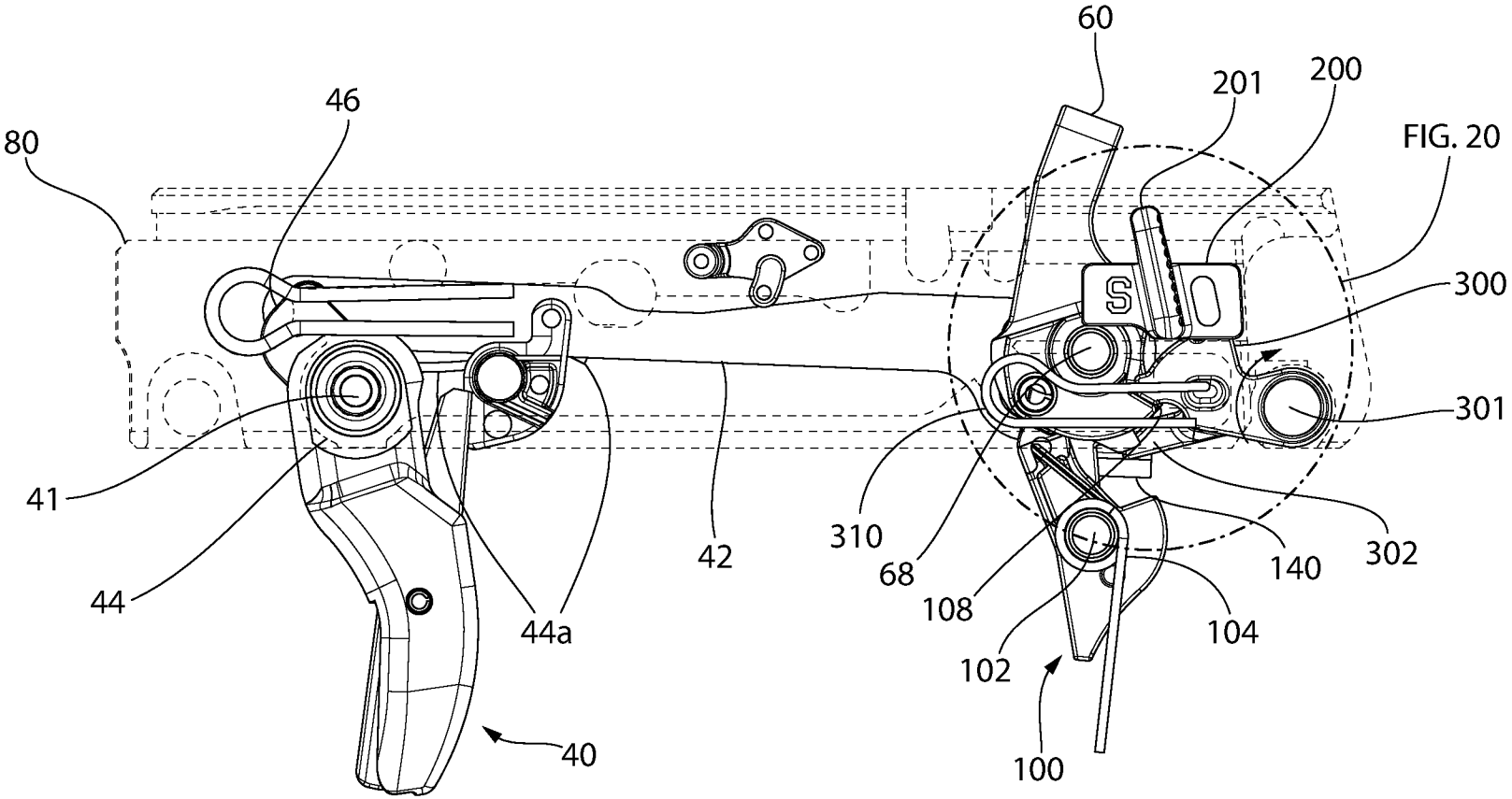
FIG. 19 is a left side view of the firearm of FIG. 1 showing the firing and safety mechanisms in the SAFE mode/position with trigger pulled.

It bears noting that the firing and safety mechanisms are shown in the SAFE mode/position in both FIGS. 15 and 19-20. In FIG. 15, the trigger 40 has not been pulled whereas in FIG. 19 the trigger is pulled while in the SAFE mode/position. If the hammer 60 were to disengage the sear somehow when the trigger were pulled even though the trigger bar 42 is not aligned with sear for actuating (note misaligned positions of sear and trigger bar protrusions 108, 140 in FIGS. 19-20), the hammer may possible start to rotate forward as shown. However, engagement of the hammer by the nose protrusion 305 of the safety link 300 prevents full rotation necessary for the hammer to reach and strike the firing pin.

The safety selector or actuator 200 and safety link 300 may be preferably formed of any suitable metallic material. In addition, the individual features of the actuator and safety link as previously described herein and shown in FIGS. 26A-H and 27A-H may preferably be formed as unitary structural portions of the monolithic bodies of these components via casting, machining, and/or other standard and suitable metal manufacturing techniques. In other possible embodiments, however, portions or features of the actuator and safety link may be discrete and separate parts which may be fixedly assembled together.

While the foregoing description and drawings represent exemplary or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm with safety mechanism comprising:

a longitudinal axis;

a frame;

a hammer pivotably disposed in the frame, the hammer moveable between a rearward cocked position and a forward firing position;

a sear pivotably disposed in the frame and configured to hold the hammer in the rearward cocked position;

a trigger mechanism comprising a trigger and trigger bar movable therewith, the trigger bar movable to selectively engage the sear for releasing the hammer from the cocked position via a trigger pull to discharge the firearm;

a manually-operated safety mechanism comprising a movable actuator and a pivotably movable safety link operably interfaced with the actuator, the safety link actuatable via moving the actuator between first and second positions;

the safety link comprising a first protrusion arranged to selectively engage the hammer when the safety link is actuated, and a second protrusion arranged to selectively engage the trigger bar when the safety link is actuated;

wherein via moving the actuator, the safety mechanism is changeable between a fire position in which the safety link is disengaged from the hammer and trigger bar which allows the firearm to be discharged in response to a trigger pull, and a safe position in which the safety link is engaged with the hammer and trigger bar to prevent the firearm from being discharged in response to a trigger pull;

wherein the actuator is axially movable between the first and second positions, and the safety link via operation of the safety actuator is pivotably movable between an upper unactuated position disengaged from the hammer and trigger bar, and a lower actuated position engaged with the hammer and trigger bar;

wherein the actuator comprises a lateral camming protrusion which slideably engages an arcuately curved camming surface on the safety link to rotate the safety link from the upper position to lower position when the actuator is moved; and further comprising a locking notch formed at one end of the camming surface of the safety link which selectively engages a complementary configured locking protrusion formed on the camming protrusion of the actuator.

2. The firearm according to claim 1, wherein the camming protrusion pushes and rotates the safety link downwards to the lower position from the upper position when the actuator is moved between the first and second positions.

3. The firearm according to claim 1, further comprising a spring which biases the safety link into the upper position.

4. The firearm according to claim 1, wherein the camming surface is disposed on the first protrusion of the safety link that engages the hammer.

5. The firearm according to claim 4, wherein sliding engagement between the first protrusion and camming protrusion of the actuator simultaneously engages the first protrusion with the hammer and the second protrusion with the trigger bar when the safety link moves to the lower position.

6. The firearm according to claim 5, wherein the second protrusion displaces the trigger bar downwards to prevent engagement between the sear and trigger bar when the trigger is pulled.

7. The firearm according to claim 5, wherein the first protrusion of the safety link engages a corresponding blocking surface on the hammer to prevent the hammer from rotating to the fire position from the cocked position when the trigger is pulled.

8. The firearm according to claim 1, wherein the first protrusion of the safety link which engages the hammer is disposed on a first lateral side of the firearm, and the second protrusion which engages the trigger bar is disposed on an opposite second lateral side of the firearm.

9. The firearm according to claim 5, wherein the safety link further includes a cross member which structurally links the first and second protrusions together such that the first and second protrusions move in unison when the safety link moves.

10. The firearm according to claim 1, wherein a pivot axis of the safety link is located rearward of a pivot axis of the hammer and sear.

11. The firearm according to claim 1, wherein the trigger bar is moveable forward via a trigger pull to engage and rotate the sear to release the hammer from the cocked position to discharge the firearm.

12. The firearm according to claim 11, wherein the sear includes an operating protrusion which is axially aligned with and engages a laterally extending operating protrusion of the trigger bar that rotates the sear when the trigger bar moves forward to release the hammer.

13. The firearm according to claim 12, wherein second protrusion of safety link engages the operating protrusion of and displaces the trigger bar downward to misalign the operating protrusions of the trigger bar and sear to prevent discharging the firearm when the trigger is pulled.

14. The firearm according to claim 13, wherein the trigger bar further comprising a window formed at a rear end which receives a pivot pin of the hammer at least partially therethrough, the window and pivot pin interfacing to act as a travel stop which limits the vertical movement of the trigger bar.

15. The firearm according to claim 1, wherein the actuator comprises a vertically oriented central portion, an elongated actuating member for grasping by a user disposed on one lateral side of the central portion, and a laterally projecting camming protrusion disposed on an opposite lateral side of the central portion which selectively engages the safety link to change positions of the safety mechanism.

16. The firearm according to claim 15, wherein the camming protrusion engages a corresponding arcuately curved camming surface on the first protrusion of the safety link which pivotably moves both the first and second protrusions of the safety link to engage the hammer and trigger bar respectively.

17. A firearm with dual-acting safety mechanism comprising:

a longitudinal axis;

a frame;

a hammer pivotably movable in the frame, the hammer moveable between a rearward cocked position and a forward firing position;

a sear pivotably movable in the frame and configured to hold the hammer in the rearward cocked position;

a trigger mechanism comprising a pivotably movable trigger and a trigger bar movably coupled to the trigger, the trigger bar axially moveable via pulling the trigger to selectively engage and rotate the sear for releasing the hammer from the cocked position to discharge the firearm;

a manually-operated safety mechanism comprising an axially slideable safety mode selector and a pivotably movable safety link, the safety link moveable between unactuated and actuated positions via sliding the actuator between first and second axial positions;

the safety link comprising a first nose protrusion on one lateral side of the firearm which is selectively operable when the safety link is in the actuated position to engage and block rotation of the hammer to prevent discharging the firearm;

the safety link further comprising a second foot protrusion on an opposite lateral side of the firearm which is selectively operable when the safety link is in the actuated position to engage and displace the trigger bar such that the trigger bar is prevented from engaging and rotating the sear to prevent discharging the firearm;

wherein the nose and foot protrusions are structurally linked together via a cross member such that moving one of the nose or foot protrusion simultaneously moves the other of the nose or foot protrusion;

wherein the actuator comprises an elongated actuating member for grasping by a user disposed on one lateral side, and a laterally projecting camming protrusion disposed on an opposite lateral side which slideably engages the safety link to change the safety link between the upper and lower positions;

wherein the camming protrusion engages a corresponding arcuately curved camming surface on the nose protrusion of the safety link which pivotably moves both the nose and foot protrusions in unison.

18. The firearm according to claim 17, wherein the nose protrusion engages a corresponding blocking surface formed on the hammer to arrest rotation of the hammer when the safety link is moved to the actuated position.

19. The firearm according to claim 18, wherein the foot protrusion engages a laterally extending operating protrusion of the trigger bar which displaces the trigger bar downward when the safety link is moved to the actuated position which prevents engagement by the sear when the trigger is pulled.

20. The firearm according to claim 19, wherein the trigger bar is moveable between an upper position in which the operating protrusion of the trigger bar is axially aligned with a mating operating protrusion of the sear to discharge the firearm when the trigger is pulled, and a lower position displaced by the foot protrusion of the safety link in which the operation protrusions of the trigger bar and sear are misaligned to prevent discharging the firearm.

21. The firearm according to claim 17, wherein: (i) the first axial position of the actuator is a forward position in which the safety link is in the unactuated position, the unactuated position being an upper position in which the nose and foot protrusions are oriented generally parallel to the longitudinal axis; and (ii) the second axial position of the actuator is a rearward position in which the safety link is in the actuated position, the actuated position being a lower position in which the nose and foot protrusions are orientated generally at a downward angle to the longitudinal axis.

* * * * *